US010953671B2

(12) United States Patent
Nonaka et al.

(10) Patent No.: US 10,953,671 B2
(45) Date of Patent: Mar. 23, 2021

(54) CLAMP AND MEDIUM CUTTING DEVICE

(71) Applicant: Roland DG Corporation, Hamamatsu (JP)

(72) Inventors: Ryosuke Nonaka, Hamamatsu (JP); Shinya Yamamoto, Hamamatsu (JP); Ippei Tanaka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 60 days.

(21) Appl. No.: 16/522,740

(22) Filed: Jul. 26, 2019

(65) Prior Publication Data

US 2020/0031145 A1 Jan. 30, 2020

(30) Foreign Application Priority Data

Jul. 27, 2018 (JP) ..... JP2018-140885
Dec. 3, 2018 (JP) ..... JP2018-226409
(Continued)

(51) Int. Cl.
*B26D 1/10* (2006.01)
*B41J 11/70* (2006.01)
(Continued)

(52) U.S. Cl.
CPC ..... *B41J 11/70* (2013.01); *B26D 1/105* (2013.01); *B26D 7/025* (2013.01); *B26D 7/0616* (2013.01);
(Continued)

(58) Field of Classification Search
CPC ..... B41J 11/70; B41J 15/04; B41J 11/0025; B41J 11/005; B41J 15/046; B26D 1/105;
(Continued)

(56) References Cited

U.S. PATENT DOCUMENTS 3,948,169 A * 4/1976 Cole ..... B41L 13/06 101/116
4,221,039 A * 9/1980 Smith ..... B25B 9/02 24/458
(Continued)

FOREIGN PATENT DOCUMENTS

CN 1232754 A 10/1999
CN 101497281 A 8/2009
(Continued)

OTHER PUBLICATIONS

Official Communication issued in corresponding Chinese Patent Application No. 201910681917.5, dated Dec. 16, 2020.

*Primary Examiner* — Kenneth E Peterson
*Assistant Examiner* — Liang Dong
(74) *Attorney, Agent, or Firm* — Keating & Bennett, LLP

(57) ABSTRACT

A clamp includes first and second rising portions that rise from a base portion, a first extending portion extending along a first top surface of a table from the first rising portion, a second extending portion extending along a second top surface of the table from the second rising portion, a first clamp portion to urge a medium toward the first top surface, and a second clamp portion to urge the medium toward the second top surface. A gap located above a groove in the table is provided between the first clamp portion and the second clamp portion.

19 Claims, 24 Drawing Sheets

(30) Foreign Application Priority Data

Jun. 10, 2019 (JP) ..... JP2019-107993
Jun. 10, 2019 (JP) ..... JP2019-107994

(51) Int. Cl.

| | |
|---|---|
| ***B26D 7/02*** | (2006.01) |
| *B26D 7/06* | (2006.01) |
| *B65H 20/02* | (2006.01) |
| *B26D 1/00* | (2006.01) |
| *B26D 7/00* | (2006.01) |
| *B41J 15/04* | (2006.01) |

(52) U.S. Cl.
CPC ..... *B26D 2001/004* (2013.01); *B26D 2007/0043* (2013.01); *B41J 15/04* (2013.01); *B65H 20/02* (2013.01)

(58) Field of Classification Search
CPC ..... B26D 7/025; B26D 7/0616; B26D 2001/004; B26D 2007/0043; B65H 20/02; B25B 11/00
USPC ..... 83/454, 455, 375; 269/43, 47, 291
See application file for complete search history.

(56) References Cited

U.S. PATENT DOCUMENTS 4,454,975 A * 6/1984 Rosenberg ..... B41J 11/30 226/74
6,230,617 B1 * 5/2001 Mori ..... B41C 1/14 101/116
6,279,900 B1 8/2001 Yamagishi
6,302,602 B1 10/2001 Kiyohara et al.
2007/0169597 A1 7/2007 Morita
2009/0196673 A1 8/2009 Akatsu et al.
2010/0288094 A1 * 11/2010 Pynt ..... B26D 7/14 83/56
2012/0134733 A1 5/2012 Ota et al.
2013/0136521 A1 * 5/2013 Garcia ..... B41J 11/005 400/642
2015/0321370 A1 * 11/2015 Corsico Piccolino ..... B26D 7/018 83/23

FOREIGN PATENT DOCUMENTS

| | | | |
|---|---|---|---|
| CN | 202412940 | U | 9/2012 |
| CN | 204263731 | U | 4/2015 |
| CN | 205661154 | U | 10/2016 |
| CN | 106585127 | A | 4/2017 |
| JP | 52-91591 | U | 7/1977 |
| JP | 54-157603 | U | 11/1979 |
| JP | 57-13200 | U | 1/1982 |
| JP | 08-11369 | A | 1/1996 |
| JP | 09-29687 | A | 2/1997 |
| JP | 09-511731 | A | 11/1997 |
| JP | 11-99717 | A | 4/1999 |
| JP | 2002-265137 | A | 9/2002 |
| JP | 2005-35681 | A | 2/2005 |
| JP | 3979903 | B2 | 9/2007 |
| JP | 2007-274909 | A | 10/2007 |
| JP | 2009-202303 | A | 9/2009 |
| JP | 2011-005831 | A | 1/2011 |
| JP | 2012-223925 | A | 11/2012 |
| JP | 2013-128995 | A | 7/2013 |
| JP | 2018-58185 | A | 4/2018 |
| JP | 2018-130880 | A | 8/2018 |
| WO | 2005/072920 | A1 | 8/2005 |

* cited by examiner

CLAMP AND MEDIUM CUTTING DEVICE

CROSS REFERENCE TO RELATED APPLICATIONS

This application claims the benefit of priority to Japanese Patent Application No. 2018-140885 filed on Jul. 27, 2018, Japanese Patent Application No. 2018-226409 filed on Dec. 3, 2018, Japanese Patent Application No. 2019-107993 filed on Jun. 10, 2019, and Japanese Patent Application No. 2019-107994 filed on Jun. 10, 2019. The entire contents of these applications are hereby incorporated herein by reference.

BACKGROUND OF THE INVENTION

1. Field of the Invention

The present invention relates to a clamp that prevents a medium placed on a table from rising from the table, and a medium cutting device including the same.

2. Description of the Related Art

It is conventionally known, in a printer or the like, to press a medium onto a table by a clamp in order to prevent the medium from rising from the table.

For example, Japanese Laid-Open Patent Publication No. 2005-35681 discloses a printer including a table on which a medium may movably be placed, and a clamp that presses the medium onto the table. The clamp includes a pair of leaf springs extending in a medium transportation direction. The pair of leaf springs are located so as not to be on a print area. This printer performs printing in a state where the medium is prevented from rising by the clamp.

The clamp may also be usable to cut the medium. For example, there is a case where the medium is to be cut in the entirety of a width direction thereof in order to cut off an area of the medium on which printing has been performed from an area of the medium on which printing is not performed. The clamp is usable in such a case. In order to cut the medium in the entirety of the width direction thereof, a cutter is moved from one end to the other end of the medium in the width direction. The clamp disclosed in Japanese Laid-Open Patent Publication No. 2005-35681 extending in the medium transportation direction, and is provided at a position closer to the center of the medium than the ends of the medium. Therefore, while the cutter is moved from the one end to the other end of the medium in the width direction thereof, the cutter and the clamp interfere with each other. For cutting the medium in the entirety of the width direction thereof, the clamp needs to be detached to avoid the interference when the cutter approaches the clamp. For this reason, the use of the clamp complicates the work of cutting the medium, and also extends the time required for the cutting work.

SUMMARY OF THE INVENTION

Preferred embodiments of the present invention provide clamps each of which prevents a medium from rising and allows the medium to be cut easily and quickly, and medium cutting devices including such clamps.

A clamp according to a preferred embodiment of the present invention is attachable to a table including a first top surface, a second top surface and a groove between the first top surface and the second top surface and extending in a first direction; and presses a medium placed on the first top surface and the second top surface onto the first top surface and the second top surface. The clamp includes a base portion accommodatable in the groove of the table; a first rising portion rising from the base portion; a first extending portion extending along the first top surface of the table from the first rising portion; a second rising portion rising from the base portion; and a second extending portion extending along the second top surface of the table from the second rising portion. The clamp further includes a first clamp portion extending in the first direction along the first top surface from the first extending portion, the first clamp portion urging the medium toward the first top surface; and a second clamp portion extending in the first direction along the second top surface from the second extending portion, the second clamp portion urging the medium toward the second top surface. A gap located above the groove of the table is provided between the first clamp portion and the second clamp portion.

A medium cutting device according to a preferred embodiment of the present invention includes the clamp.

In the clamp, the first clamp and the second clamp press the medium onto the first top surface and the second top surface of the table, and therefore, the medium is prevented from rising. A gap located above the groove of the table is provided between the first clamp and the second clamp. Therefore, a cutter is allowed to pass between the first clamp and the second clamp. For this reason, the clamp allows the medium to be cut along the groove while pressing the medium onto the table. Since the cutter and the clamp do not interfere with each other, the clamp does not need to be detached. Therefore, the medium is cut easily and quickly.

Preferred embodiments of the present invention provide clamps each of which prevents a medium from rising and allows the medium to be cut easily and quickly, and medium cutting devices including such clamps.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred Embodiment 1

Figure 1:
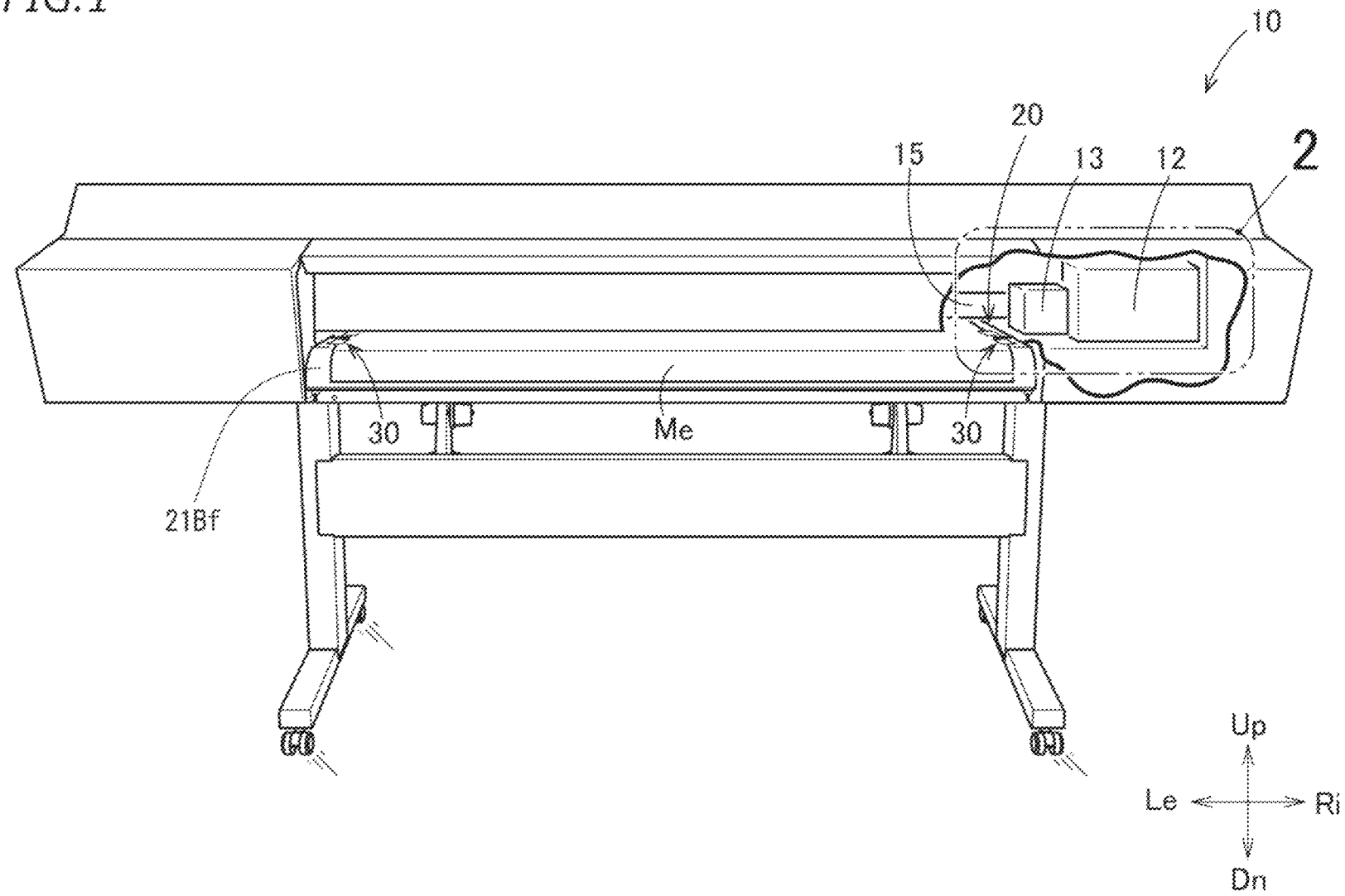
FIG. 1 is a front view of a printer/medium cutting device according to preferred embodiment 1 of the present invention.

Preferred embodiments of the present invention will be described with reference to the attached drawings. FIG. 1 shows a printer/medium cutting device 10 (hereinafter, referred to simply as the "printer device 10") capable of performing printing on, and cutting, a medium Me. The printer device 10 is one example of a medium cutting device in the sense of being capable of cutting the medium Me.

In the following description, in a state where a user looks at a front surface of the printer device 10 as shown in FIG. 1, a direction in which the user is distanced away from the printer device 10 will be referred to as a "forward direction", and a direction in which the user approaches the printer device 10 will be referred to as a "rearward direction". As described below, the medium Me on a table 20 is transported forward in order to have printing performed thereon. In the following description, the terms "forward" and "rearward" correspond to "forward" and "rearward" regarding such a transportation direction of the medium Me. Namely, a downstream side of the transportation direction corresponds to forward, and an upstream side of the transportation direction corresponds to rearward. A "downstream direction" refers to a direction from a rear position to a front position. An "upstream direction" refers to a direction from a front position to a rear position. In the drawings, Fr indicates "front", and Rr indicates "rear". Le indicates "left", Ri indicates "right", Up indicates "up", and Dn indicates "down".

Figure 4:
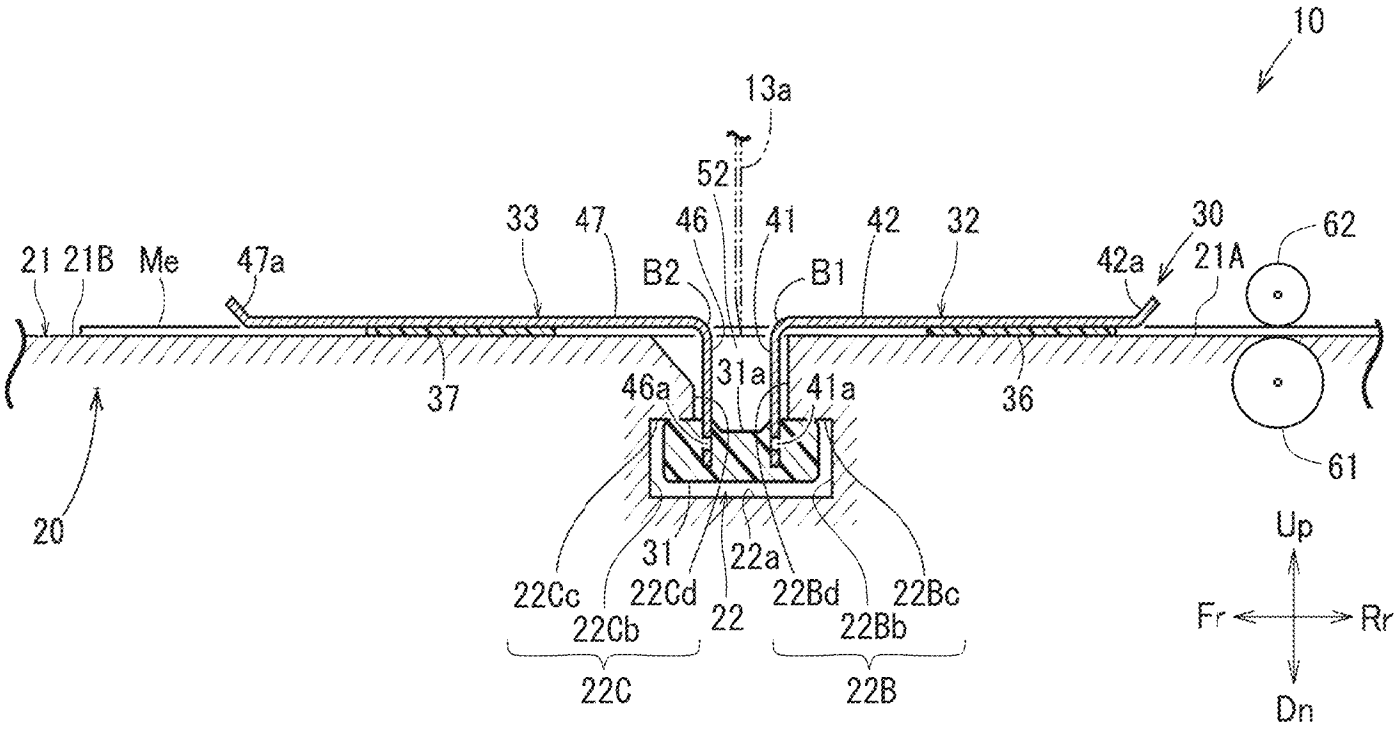
FIG. 4 is a cross-sectional view taken along line 4-4 in FIG. 3.

The printer device 10 includes the table 20 supporting the medium Me such that the medium Me is transportable, a carriage on which a plurality of printing heads 12A (see FIG. 2) performing printing on the medium Me are mounted, a cutter mechanism 13 capable of cutting the medium Me, and left and right clamps 30 clamping (i.e., pressing) left and right ends of the medium Me onto the table 20. The printer device 10 further includes feed rollers 61 (see FIG. 4; only one is shown in FIG. 4) moving the medium Me forward and rearward (i.e., in a front-rear direction) and pinch rollers 62 (only one is shown in FIG. 4) holding the medium Me together with the feed rollers 61.

The printer device 10 is capable of transporting the medium Me in the front-rear direction by the feed rollers 61. The carriage 12 is movable in a left-right direction. The cutter mechanism 13 is connected with the carriage 12, and is movable in the left-right direction together with the carriage 12. The printing heads 12A inject ink toward the medium Me sequentially transported in the front-rear direction while the carriage 12 moves in the left-right direction, so that printing is performed on the medium Me. In order to cut the medium Me, the medium Me is transported to a predetermined position, and the cutter mechanism 13 is moved in the left-right direction in a state where the left and right ends of the medium Me are clamped by the clamp 30.

Figure 2:
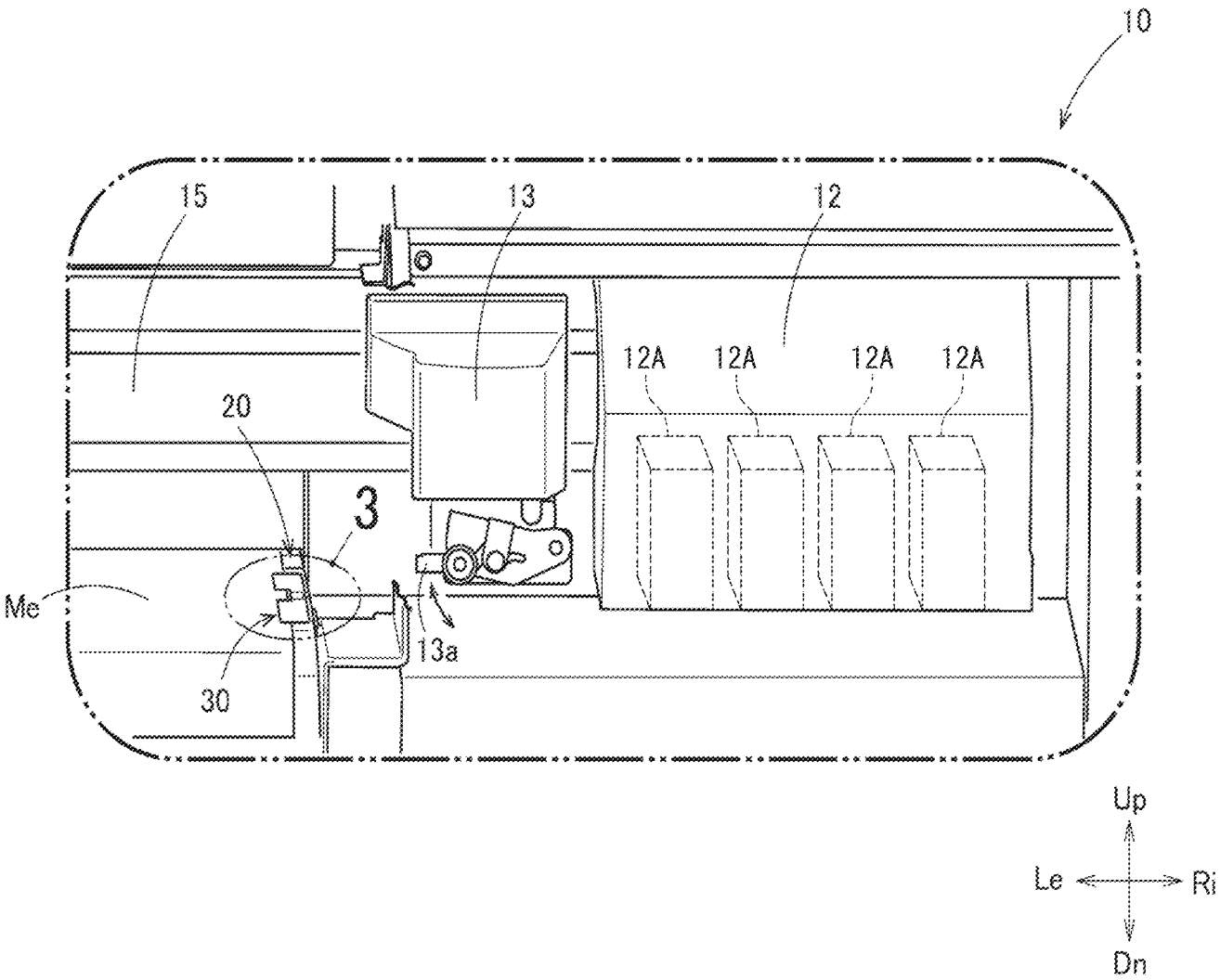
FIG. 2 is an enlarged view of portion 2 in FIG. 1.

As shown in FIG. 2, the carriage 12 is movably supported by a guide rail 15 extending in the left-right direction. Although not shown, the carriage 12 is coupled with a belt wound along driving and subordinate pulleys. The driving pulley is coupled with a carriage driving motor 81 (see FIG. 10) described below. When the carriage driving motor 81 drives the driving pulley, the belt runs and thus the carriage 12 moves in the left-right direction along the guide rail 15. On the carriage 12, the plurality of printing heads 12A are mounted. There is no specific limitation on the number of the printing heads 12A mounted on the carriage 12. In this example, the plurality of printing heads 12A mounted on the carriage 12 inject different colors of ink from each other.

The cutter mechanism 13 is movable in the left-right direction along the guide rail 15 together with the carriage 12. The cutter mechanism 13 is movably supported by the guide rail 15. The cutter mechanism 13 may be indirectly supported by the guide rail 15 via the carriage 12, or may be directly supported by the guide rail 15. The cutter mechanism 13 includes a blade (cutter) 13*a* capable of cutting the medium Me. The blade 13*a* is provided so as to be swingable in an up-down direction. When being rotated upward, the blade 13*a* is positioned at a retraction position, which is away from the medium Me. When being rotated downward, the blade 13*a* is positioned at a contact position, at which the blade 13*a* contacts the medium Me. In order to cut the medium Me, the blade 13*a* is rotated to the contact position, and the cutter mechanism 13 is moved in the left-right direction.

The medium Me is, for example, a roll medium, which is provided in a rolled state. The medium Me may be formed of paper such as plain paper or the like, a resin such as poly(vinyl chloride), polyester or the like, or a metal material such as aluminum, iron or the like. The medium Me may be formed of any of various materials. In order to have printing performed thereon, the medium Me is transported forward by the feed rollers 61.

Figure 3:
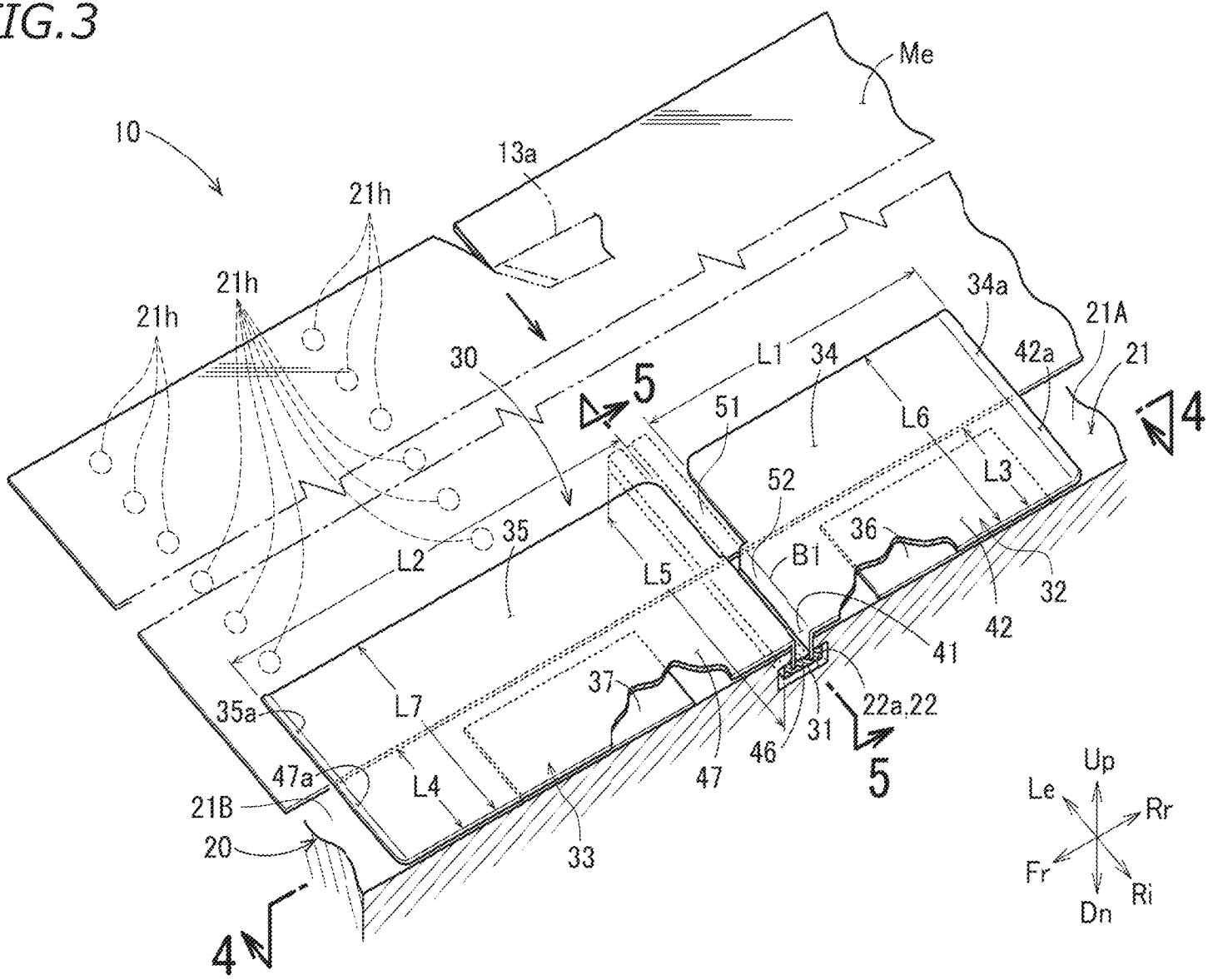
FIG. 3 is an enlarged view of portion 3 in FIG. 2.

As shown in FIG. 3, at least a portion of a top surface of the table 20 is planar and extends in the front-rear direction and in the left-right direction. The medium Me moves on the top surface 21. A groove 22 extends in the left-right direction in a portion of the top surface 21. Namely, the groove extends in a direction perpendicular to the transportation direction of the medium Me. Where the direction in which the groove 22 extends is a first direction and the direction in which the medium Me is transported on the table 20 is a second direction, the first direction and the second direction are perpendicular to each other. The top surface 21 includes a first top surface 21A located to the rear of the groove 22, and a second top surface 21B located to the front of the groove 22. In other words, the groove 22 is provided between the first top surface 21A and the second top surface 21B. As shown in FIG. 1, a front portion 21Bf of the second top surface 21B is inclined downward from a horizontal plane as extending forward. As shown in FIG. 3, adsorption holes 21*h*, through which the medium Me is adsorbed downward, are formed in at least the second top surface 21B. There is no specific limitation on the number and the position(s) of the adsorption hole(s) 21*h*. In this example, a plurality of the adsorption holes 21*h* are arrayed in the left-right direction to form an adsorption hole array. The adsorption holes 21*h* are arrayed in two lines, more specifically, a front line and a rear line.

Figure 9:
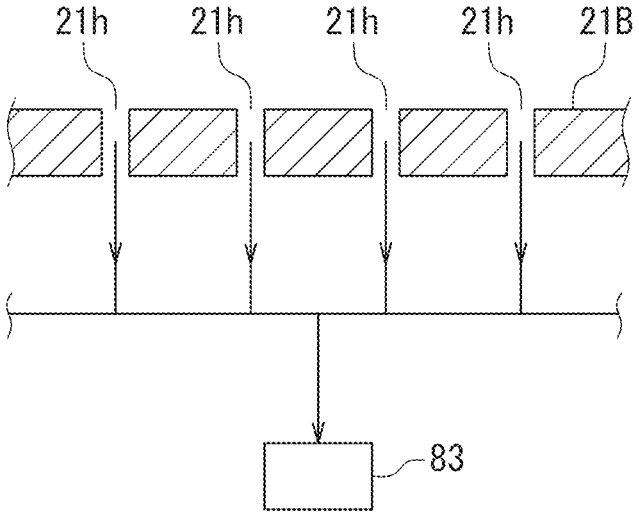
FIG. 9 is a conceptual view illustrating adsorption holes of the table and a fan.

As shown in FIG. 9, the adsorption holes 21*f* are in communication with a fan 83, which is one example of absorption device. The fan 83 is configured to absorb air from above toward the adsorption holes 21*h*. The fan 83 is configured to cause the medium Me to adsorb to at least the second top surface 21B. The adsorption holes 21*h* in communication with the fan 83 may also be formed in the first top surface 21A. In this case, the fan 83 causes the medium Me to adsorb to the first top surface 21A and the second top surface 21B.

As shown in FIG. 4, the groove 22 is generally inverted T-shaped. The groove 22 includes a bottom wall portion 22*a* extending in the left-right direction (in the depth direction of FIG. 4), a side wall portion 22C located to the front of the bottom wall portion 22*a*, and a side wall portion 22B located to the rear of the bottom wall portion 22*a*. The front side wall portion 22C and the rear side wall portion 22B cross the bottom wall portion 22*a*. The front side wall portion 22C and the rear side wall portion 22B are spaced away from each other in the front-rear direction. The rear side wall portion 22B includes an accommodation wall portion 22Bb crossing the bottom wall portion 22*a* and a pullout-preventive wall portion 22Bd located above the accommodation wall portion 22Bb. Similarly, the front side wall portion 22C includes an accommodation wall portion 22Cb crossing the bottom wall portion 22*a* and a pullout-preventive wall portion 22Cd located above the accommodation wall portion 22Cb. The accommodation wall portion 22Bb and the accommodation wall portion 22Cb face each other in the front-rear direction, and the pullout-preventive wall portion 22Bd and the pullout-preventive wall portion 22Cd face each other in the front-rear direction.

The rear pullout-preventive wall portion 22Bd protrude forward with respect to the accommodation wall portion 22Bb. A stopper wall 22Bc extending forward is provided between the rear pullout-preventive wall portion 22Bd and the accommodation wall portion 22Bb. The front pullout-preventive wall portion 22Cd protrude rearward with respect to the accommodation wall portion 22Cb. A stopper wall 22Cc extending rearward is provided between the rear pullout-preventive wall portion 22Cd and the accommodation wall portion 22Cb.

A top portion of the front pullout-preventive wall portion 22Cd is inclined forward as extending upward, namely, is tapered. The rear pullout-preventive wall portion 22Bd extends in the up-down direction. It should be noted that these shapes are mere examples. The front pullout-preventive wall portion 22Cd may extend in the up-down direction, like the rear pullout-preventive wall portion 22Bd. A top portion of the rear pullout-preventive wall portion 22Bd may be inclined rearward as extending upward, namely, may be tapered, like the front pullout-preventive wall portion 22Cd.

Now, the clamp 30 clamping the medium Me to the table 20 will be described in detail. As described above, two clamps 30 are used (see FIG. 1) to clamp the left and right ends of the medium Me respectively. Hereinafter, the right clamp 30 will be described. The left clamp 30 is bilaterally symmetric to the right clamp 30, but except for this, has substantially the same structure as that of the right clamp 30. Therefore, the left clamp 30 will not be described.

As shown in FIG. 3 and FIG. 4, the clamp 30 includes a base portion 31 accommodatable in the groove 22, a first member 32 and a second member 33 supported by the base portion 31, and a first spacer 36 and a second spacer 37.

The base portion 31 is formed of a hard resin by molding. For example, the base member 31 may be formed of polyacetal (POM) or polypropylene (PP). As shown in FIG. 4, the base portion 31 is accommodated between the front accommodation wall portion 22Cb and the rear accommodation wall portion 22Bb. Front and rear top surfaces of the base portion 31 are respectively in contact with the stopper walls 22Cc and 22Bc of the groove 22. This prevents the base portion 31 from being pulled upward out of the groove 22.

A central portion of the base portion 31 in the front-rear direction is recessed. A portion of the base portion 31 that is between a portion thereof into which the first member 32 is inserted and a portion thereof into which the second member 33 is inserted is a thin portion 31*a*, which is thinner than the portions into which the first member 32 and the second member 33 are inserted. The thin portion 31*a* is formed in the entirety of the left-right direction of the base member 31. The thin portion 31*a* has a top surface that is bored downward from the level of the portions into which the first member 32 and the second member 33 are inserted.

As shown in FIG. 3 and FIG. 4, the first member 32 is defined by a bent plate. The first member 32 is formed by, for example, press-molding a steel plate. There is no specific limitation on the material of the first member 32, and any material such as a metal material, a resin or the like is usable as well as the steel. The first member 32 is generally L-shaped as seen in a right side view. The first member 32 includes a first rising portion 41, a first extending portion 42, and a first clamp portion 34. As shown in FIG. 4, the first rising portion 41 rises from the base portion 31, and extends upward from the base portion 31. The first extending portion 42 extends on the first top surface 21A of the table 20 from the first rising portion 41. The first extending portion 42 is bent rearward from a tip portion of the first rising portion 41, and extends rearward. The first extending portion 42 extends in a direction away from the groove 22. A tip portion 42*a* of the first extending portion 42 is bent obliquely upward. The tip portion 42*a* is inclined upward with respect to the first top surface 21A as extending rearward.

The second member 33 has substantially the same structure as that of the first member 32. Namely, the second member 33 is defined by a bent plate. The second member 33 is formed by, for example, press-molding a steel plate. There is no specific limitation on the material of the second member 33, and any material such as a metal material, a resin or the like is usable as well as the steel. The second member 33 is generally L-shaped as seen in a right side view. The second member 33 includes a second rising portion 46, a second extending portion 47, and a second clamp portion 35. As shown in FIG. 4, the second rising portion 46 rises from the base portion 31, and extends upward from the base portion 31. The second extending portion 47 extends on the second top surface 21B of the table 20 from the second rising portion 46. The second extending portion 47 is bent forward from a tip portion of the second rising portion 46, and extends forward. The second extending portion 47 extends in a direction away from the groove 22. A tip portion 47*a* of the second extending portion is bent obliquely upward. The tip portion 47*a* is inclined upward with respect to the second top surface 21B as extending forward.

The second rising portion 46 is provided generally parallel to the first rising portion 41. The first rising portion and the second rising portion 46 are spaced away from each other, and a gap 52 extending in the left-right direction (see also FIG. 3) is provided between the first rising portion 41 and the second rising portion 46. A distance between a rear surface of the first rising portion 41 and a front surface of the second rising portion 46 is shorter than a distance between the front pullout-preventive wall portion 22Cd and the rear pullout-preventive wall portion 22Bd. Therefore, the first rising portion 41 is away from the rear pullout-preventive wall portion 22Bd, or the second rising portion 46 is away from the front pullout-preventive wall portion 22Cd.

As shown in FIG. 3, length L1 in the front-rear direction of the first extending portion 42 is shorter than length L2 in the front-rear direction of the second extending portion 47. Length L3 in the left-right direction of the first extending portion 42 is equal to length L4 in the left-right direction of the second extending portion 47. The relationship between these distances are not specifically limited to the above. The relationship between lengths L1 and L2 may be L1=L2 or L1>L2. The relationship between lengths L3 and L4 may be L3>L4 or L3<L4.

As shown in FIG. 3, length L5 in the left-right direction of the base portion 31 is longer than total length L6 in the left-right direction of the first extending portion 42 and the first clamp portion 34, and is longer than total length L7 in the left-right direction of the second extending portion 47 and the second clamp portion 35. L6=L7. The relationship between L6 and L7 may be L6<L7 or L6>L7.

The first clamp portion 34 is integrally formed with the first extending portion 42. The first rising portion 41, the first extending portion 42 and the first clamp portion 34 are integrally defined by a unitary plate. The first clamp portion 34 extends leftward (direction in which the groove 22 extends and direction away from the first rising portion 41) along the first top surface 21A from the first extending portion 42, and presses the medium Me onto the first top surface 21A. An end of the medium Me is covered with the first clamp portion 34 and thus is prevented from rising from the first top surface 21A. A tip portion 34*a* of the first clamp portion 34 is bent obliquely upward. The tip portion 34*a* is inclined upward with respect to the first top surface 21A as extending rearward. The tip portion 34*a* defines and functions as a guide that guides the medium Me transported forward to a region below the first clamp portion 34. The tip portion 34*a* inclined with respect to the first top surface 21A may be provided in a left portion of the first clamp portion 34 as well as in a rear portion thereof.

The second clamp portion 35 is integrally formed with the second extending portion 47. The second rising portion 46, the second extending portion 47 and the second clamp portion 35 are integrally defined by a unitary plate. The second clamp portion 35 extends leftward (direction in which the groove 22 extends and direction away from the second rising portion 46) along the second top surface 21B from the second extending portion 47, and presses the medium Me onto the second top surface 21B. The end of the medium Me is covered with the second clamp portion 35 and thus is prevented from rising from the second top surface 21B. A tip portion 35*a* of the second clamp portion 35 is bent obliquely upward. The tip portion 35*a* is inclined upward with respect to the second top surface 21B as extending forward. The tip portion 35*a* defines and functions as a guide that guides the medium Me transported rearward to a region below the second clamp portion 35. The tip portion 35*a* inclined with respect to the second top surface 21B may be provided in a left portion of the second clamp portion 35 as well as in a front portion thereof.

Although not shown, the cutter mechanism 13 (see FIG. 2) may include a roller that presses the medium Me. When the cutter mechanism 13 moves in the left-right direction, the roller presses the medium Me onto the table 20 while rolling on the medium Me. The first clamp portion 34 and the second clamp portion 35 may be configured to be pressed by the roller. An operation of cutting the medium Me may be performed in a state where the roller presses the first clamp portion 34 and the second clamp portion 35, so that the blade 13*a* is put into contact with the medium Me in a state where the medium Me is prevented from being rising. This improves the cutting precision.

As shown in FIG. 3, the first spacer 36 and the second spacer 37 are each a rectangular resin plate. There is no specific limitation on the shape or the size of the first spacer 36 and the second spacer 37. The first spacer 36 and the second spacer 37 may have different sizes or shapes from each other or may have the same size or shape as each other. The first spacer 36 and the second spacer 37 may be defined by common components, namely, components having the same size and the same shape. The first spacer 36 is provided on a bottom surface of the first extending portion 42, and is in contact with the first top surface 21A. The first spacer 36 is located between the first top surface 21A and the first extending portion 42. The second spacer 37 is provided on a bottom surface of the second extending portion 47, and is in contact with the second top surface 21B. The second spacer 37 is located between the second top surface 21B and the second extending portion 47. For example, the first spacer 36 and the second spacer 37 are respectively bonded to the bottom surfaces of the first extending portion 42 and the second extending portion 47 with an adhesive. The first clamp portion 34 is away from the first top surface 21A of the table 20 by a thickness of the first spacer 36. The second clamp portion 35 is away from the second top surface 21B of the table 20 by a thickness of the second spacer 37. With such an arrangement, a gap having a size larger than, or equal to, a thickness of the medium is provided between the first clamp portion 34 and the first top surface 21A and between the second clamp portion 35 and the second top surface 21B.

In this preferred embodiment, the first spacer 36 is formed separately from the first member 32, and is bonded to the first extending portion 42. The second spacer 37 is formed separately from the second member 33, and is bonded to the second extending portion 47. Alternatively, the first spacer 36 and the first member 32 may be integral with each other, and the second spacer 37 and the second member 33 may be integral with each other. The first member 32 and the first spacer 36 may be provided as a single component, and the second member 33 and the second spacer 37 may be provided as a single component.

There is no specific limitation on the method for producing the clamp 30. For example, the clamp 30 may be formed by insert molding. In this case, the clamp 30 is produce as follows, for example. First, a metal plate is processed to form the first member 32. Another metal plate is processed to form the second member 33. Next, the first member 32 and the second member 33 are set in a mold such that the first rising portion 41 and the second rising portion 46 face each other. A resin is supplied to the mold, and a bottom end of the first rising portion 41 and a bottom end of the second rising portion 46 are joined together with the resin. This resin forms the base portion 31. Then, the base portion 31, the first member 32 and the second member 33 are pulled out of the mold, and the first spacer 36 and the second spacer 37 are respectively bonded to rear surfaces (i.e., bottom surfaces) of the first extending portion 42 and the second extending portion 47. The clamp 30 is produced in this manner.

As shown in FIG. 4, through-holes 41*a* and 46*a* may be respectively formed in portions of the first rising portion 41 and the second rising portion 46 that are covered with the base portion 31. The through-holes 41*a* and 46*a* may be filled with the resin, so that the base portion 31 supports the first rising portion 41 and the second rising portion 46 more strongly. The through-holes 41*a* and 46*a* do not need to be formed necessarily.

Figure 6A:
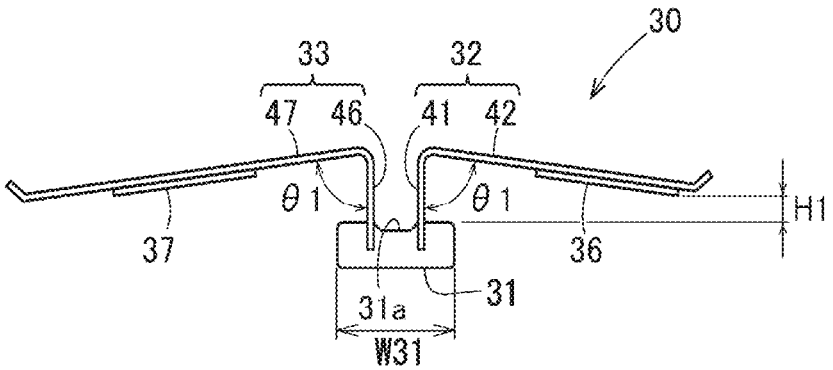
FIG. 6A is a side view of a clamp in a state of not being attached to a table.
Figure 6B:
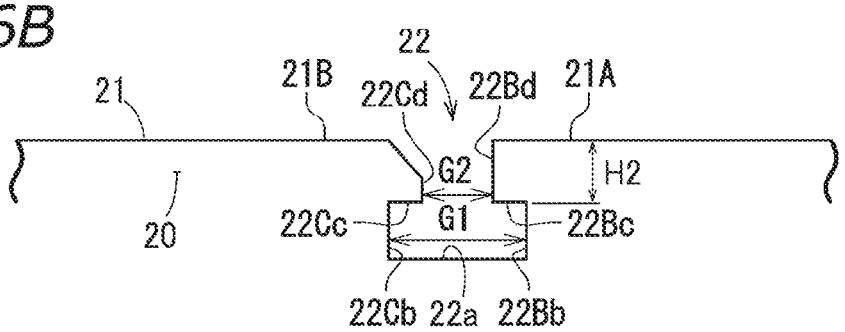
FIG. 6B is a side view of the table having no clamp attached thereto.

FIG. 6A is a right side view of the clamp 30 before the clamp 30 is attached to the table 20. FIG. 6B is a right side view of a portion of the table 20 having no clamp 30 attached thereto.

As shown in FIG. 6A, in the clamp 30 before being attached to the table 20, angle θ1 made by the first rising portion 41 and the first extending portion 42 is smaller than 90 degrees. θ1<90°. In this preferred embodiment, the angle defined by the first rising portion 41 and the first extending portion 42 is equal to an angle defined by the second rising portion 46 and the second extending portion 47. The angle defined by the second rising portion 46 and the second extending portion 47 is also angle θ1, and is smaller than 90 degrees. Alternatively, the angle defined by the second rising portion 46 and the second extending portion 47 may be different from angle θ1 made by the first rising portion 41 and the first extending portion 42 and may be smaller than 90 degrees.

A height from the top surface of the base portion 31 to a bottom end of the first spacer 36 is H1. A height from the top surface of the base portion 31 to a bottom end of the second spacer 37 is also H1. As shown in FIG. 6B, a height from the stopper wall 22Bc to the first top surface 21A, and a height from the stopper wall 22Cc to the second top surface 21B, are each H2. H1<H2. It is sufficient that height H1 from the top surface of the base portion 31 to the bottom end of the first spacer 36 is smaller than height H2 from the stopper wall 22Bc to the first top surface 21A, and that height H1 from the top surface of the base portion 31 to the bottom end of the second spacer 37 is smaller than height H2 from the stopper wall 22Cc to the second top surface 21B. There is no limitation on the numerical values thereof. The height from the top surface of the base portion 31 to the bottom end of the first spacer 36 may be different from the height from the top surface of the base portion 31 to the bottom end of the second spacer 37. The height from the stopper wall 22Bc to the first top surface 21A may be different from the height from the stopper wall 22Cc to the second top surface 21B.

The clamp 30 is attachable to, and detachable from, the table 20. Now, a method for attaching the clamp 30 to the table 20 will be described.

Figure 7:
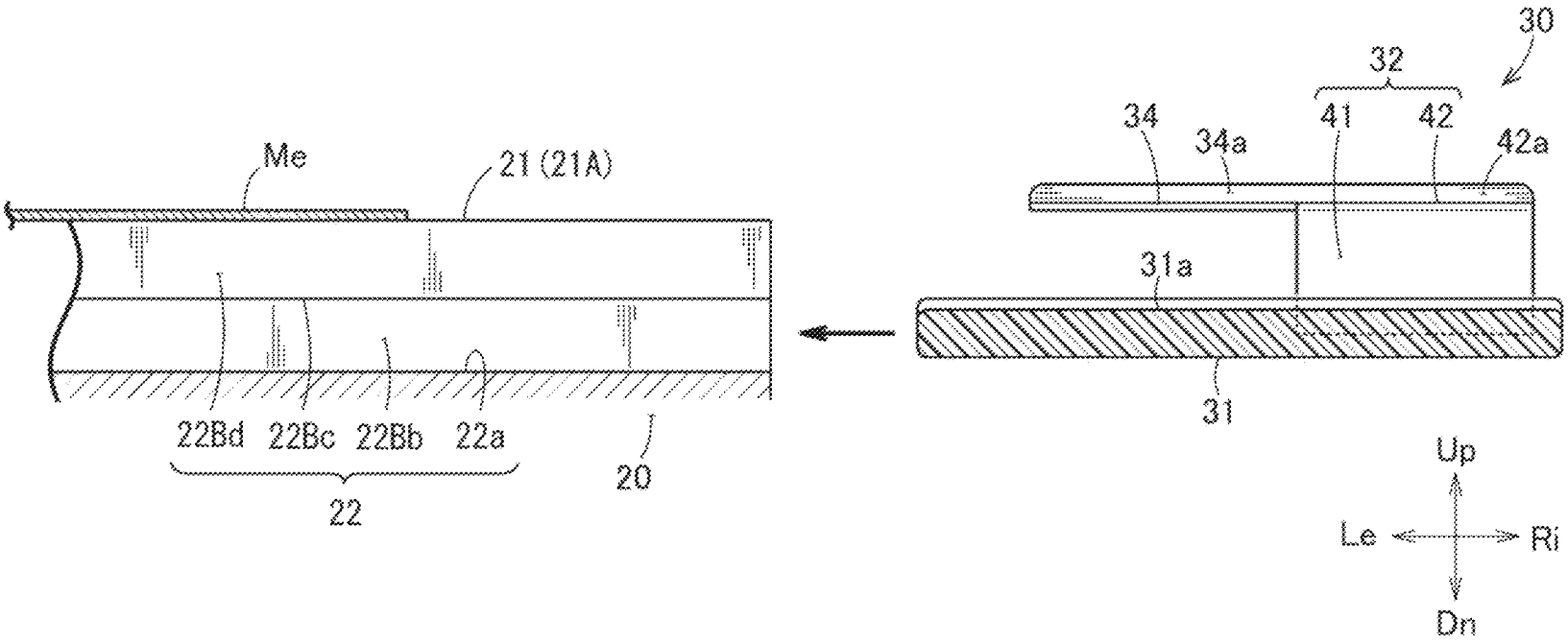
FIG. 7 illustrates a method for attaching the clamp to the table.

As shown in FIG. 7, in order to attach the clamp 30 to the table 20, the clamp 30 is slid from a side surface of the table 20 and inserted into the groove 22. In more detail, the base portion 31 is inserted into a region enclosed by the bottom wall portion 22*a*, the accommodation wall portions 22Bb and 22Cb, and the stopper walls 22Bc and 22Cc. Then, the base portion 31 is pushed until the first clamp portion 34 is located above the first top surface 21A and the second clamp portion 35 is located above the second top surface 21B.

As described above, height H1 from the top surface of the base portion 31 to the bottom end of the first spacer 36 is smaller than height H2 from the stopper wall 22Bc to the first top surface 21A. Height H1 from the top surface of the base portion 31 to the bottom end of the second spacer 37 is smaller than height H2 from the stopper wall 22Cc to the second top surface 21B. Therefore, in order to further push the base portion 31, as shown in FIG. 6C, the first extending portion 42 and the second extending portion 47 are elastically deformed such that the first spacer 36 is located above the first top surface 21A and such that the second spacer 37 is located above the second top surface 21B.

Figure 6C:
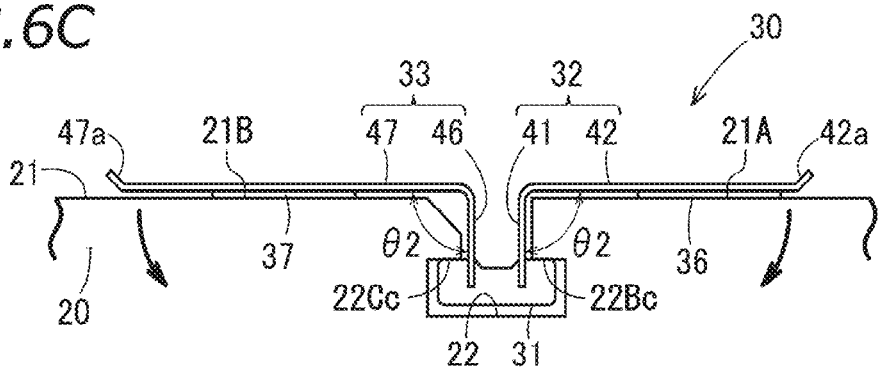
FIG. 6C is a side view of the clamp and the table in a state where the clamp is attached to the table.

FIG. 6C is a right side view of the clamp 30 and the table 20 in a state where the clamp 30 is attached to the table 20. When the base portion 31 is pushed into the groove 22 while the first extending portion 42 and the second extending portion 47 are elastically deformed, the top surface of the base portion 31 contacts the stopper walls 22Bc and 22Cc and the first and second spacers 36 and 37 respectively contact the first top surface 21A and the second top surface 21B. The first top surface 21A of the table 20 is supplied with an elastic force of the first extending portion 42 via the first spacer 36. The second top surface 21B of the table 20 is supplied with an elastic force of the second extending portion 47 via the second spacer 37.

In a state where the clamp 30 is attached to the table 20, an angle defined by the first rising portion 41 and the first extending portion 42 is set as θ2. In this case, an angle defined by the second rising portion 46 and the second extending portion 47 is also θ2. In this example, θ2=90°. θ2 merely needs to be larger than θ1, and does not need to be 90 degrees. The angle defined by the second rising portion 46 and the second extending portion 47 may be different from the angle defined by the first rising portion 41 and the first extending portion 42.

The first top surface 21A and the second top surface 21B of the table 20 are respectively supplied with the elastic forces of the first extending portion 42 and the second extending portion 47. In this state, it is difficult to slide the clamp 30 in the left-right direction. Thus, referring to FIG. 6D, the clamp 30 may be slid along the groove 22 while a border B1 between the first rising portion 41 and the first extending portion 42 and a border B2 between the second rising portion 46 and the second extending portion 47 are pushed downward by a finger. As a result, only a portion of the first spacer 36 contacts the first top surface 21A and only a portion of the second spacer 37 contacts the second top surface 21B. In addition, the base portion 31 is pushed down via the first rising portion 41 and the second rising portion 46, and therefore, is separated from the stopper walls 22Bc and 22Cc.

The central portion of the base portion 31 is the thin portion 31*a*, which is thinner than the rest of the base portion 31. This allows the base portion 31 to be bent easily. It is preferred that the thin portion 31*a* is formed as being continued from the first rising portion 41 and the second rising portion 46.

After the clamp 30 is slid to a desired position, the finger is removed from the borders B1 and B2 of the clamp 30. When the finger is removed, the first spacer 36 is pressed onto the first top surface 21A and the second spacer 37 is pressed onto the second top surface 21B respectively by the elastic forces of the first extending portion 42 and the second extending portion 47. In addition, the base portion 31 is pressed onto the stopper walls 22Bc and 22Cc. As a result, the clamp 30 is secured to the table 20.

As described above and as shown in FIG. 3, in this preferred embodiment, length L5 in the left-right direction of the base portion 31 is longer than total length L6 in the left-right direction of the first extending portion 42 and the first clamp portion 34, and is longer than total length L7 in the left-right direction of the second extending portion 47 and the second clamp portion 35. Namely, the base portion 31 is preferably relatively long. Since the base portion 31 is relatively long, the following effects are provided.

Figure 8A:
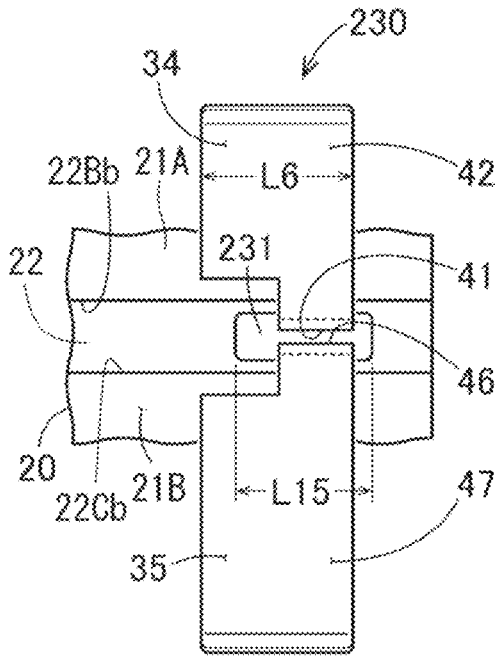
FIG. 8A is a plan view of a clamp according to another preferred embodiment in a state of being attached to a groove of the table without being inclined with respect to the groove.

FIG. 8A schematically shows a clamp 230 as another preferred embodiment of the clamp. In the clamp 230, length L15 in the left-right direction of a base portion 231 is relatively short. In the clamp 230, length L15 of the base portion 231 is shorter than total length L6 in the left-right direction of the first extending portion 42 and the first clamp portion 34. Regarding the other elements, the clamp 230 is substantially the same as the clamp 30 in the above-described preferred embodiment. Thus, the same reference signs will be used and detailed descriptions thereof will be omitted.

The clamps 30 and 230 are slidable along the groove 22. Therefore, as shown in FIG. 6A and FIG. 6B, width W31 in the front-rear direction of each of the base portions 31 and 231 is shorter than gap G1 between the front accommodation wall portion 22Cb and the rear accommodation wall portion 22Bb. For this reason, as seen in a plan view, the base portions 31 and 231 may undesirably be inclined inside the groove 22.

Figure 8B:
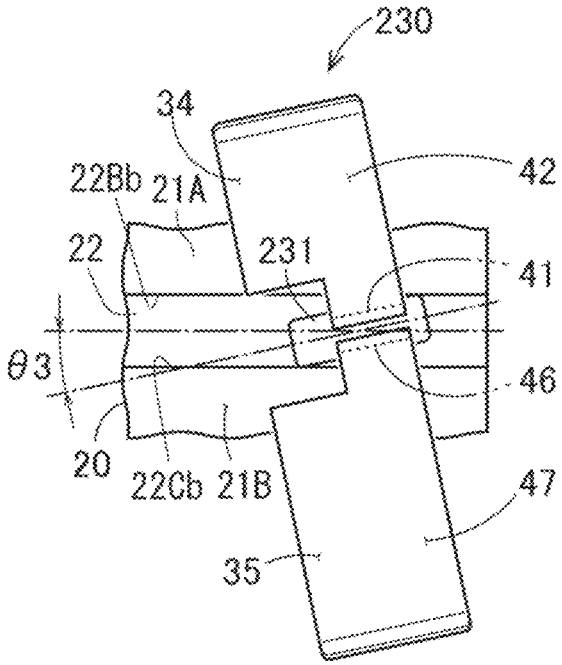
FIG. 8B is a plan view of the clamp according to the another preferred embodiment in a state of being attached to the groove in an inclined manner.
Figure 8C:
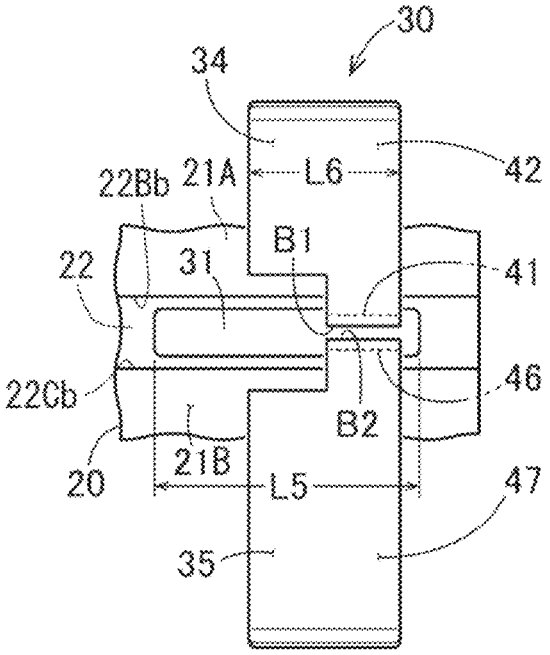
FIG. 8C is a plan view of the clamp according to preferred embodiment 1 in a state of being attached to the groove of the table without being inclined with respect to the groove.
Figure 8D:
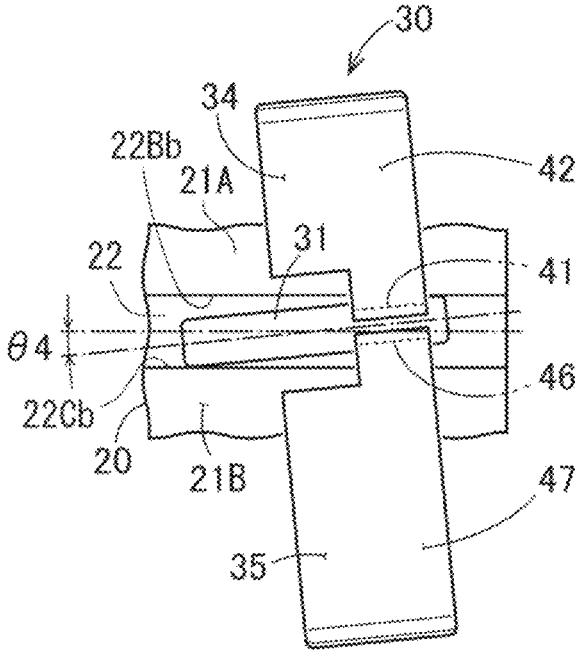
FIG. 8D is a plan view of the clamp according to preferred embodiment 1 of the present invention in a state of being attached to the groove in an inclined manner.

FIG. 8B shows a state where the clamp 230 is inclined inside the groove 22. FIG. 8C schematically shows the clamp 30. FIG. 8D shows a state where the clamp 30 is inclined inside the groove 22. As shown in FIG. 8B, in the state where the base portion 231 of the clamp 230 is inclined with respect to a center line of the groove 22, the inclination angle is set as θ3. As shown in FIG. 8D, in the state where the base portion 31 of the clamp 30 is inclined with respect to the center line of the groove 22, the inclination angle is set as θ4. In this case, θ4<θ3. Namely, the clamp 30, in which length L5 in the left-right direction of the base portion 31 is longer, is inclined less than the clamp 230, in which length L15 in the left-right direction of the base portion 231 is shorter. Therefore, the clamp 30 in this preferred embodiment is prevented from being inclined with respect to the transportation direction of the medium Me.

Figure 10:
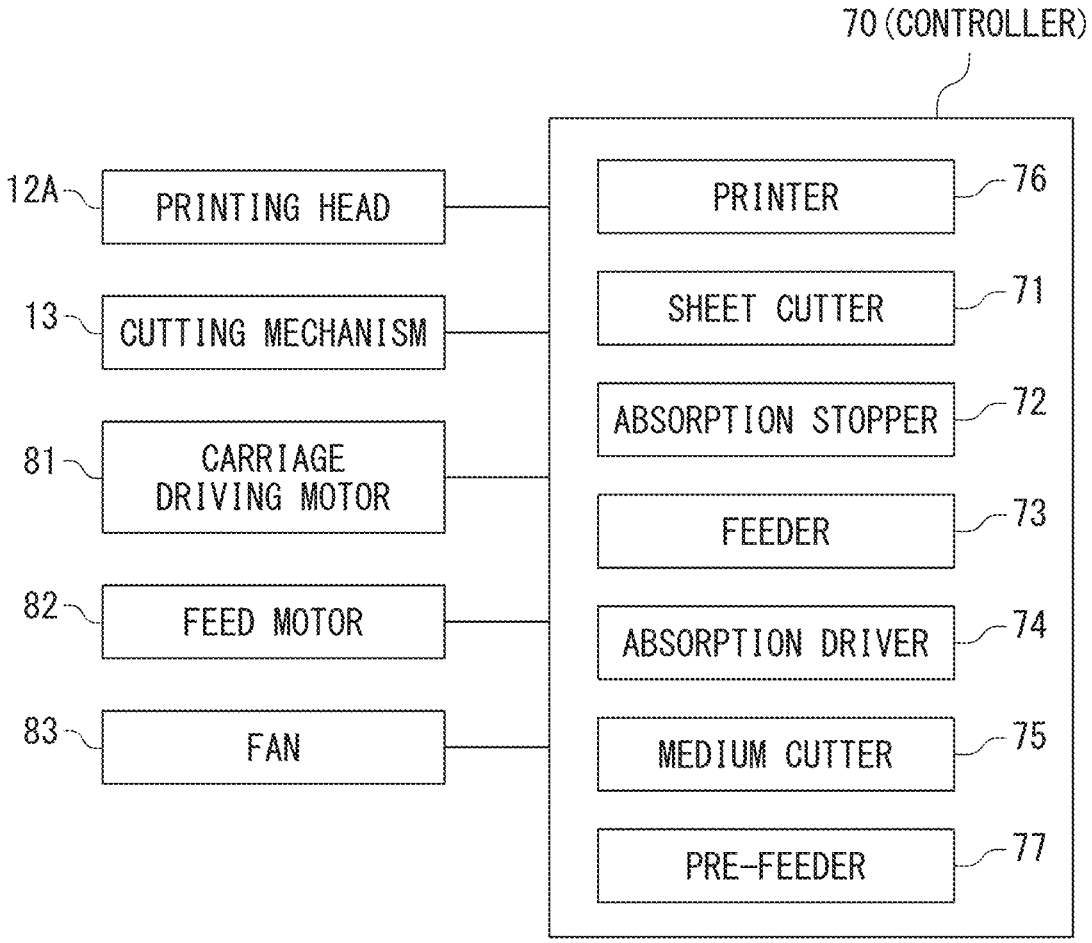
FIG. 10 is a block diagram of a controller of the printer/medium cutting device.

Now, a control system included in the printer device 10 will be described. As shown in FIG. 10, the printer device 10 includes the carriage driving motor 81 driving the carriage 12, feed motor 82 (feed mechanism) respectively driving the feed rollers 61, the fan 83 absorbing air through the adsorption holes 21*h* of the table 20 to cause the medium Me to adsorb to the table 20, and a controller 70. The controller 70 is communicably connected with the printing heads 12A, the cutter mechanism 13, the carriage driving motor 81, the feed motor 82 and the fan 83, and controls operations of these elements. The controller 70 includes a printer 76, a sheet cutter 71, an absorption stopper 72, a feeder 73, an absorption driver 74, a medium cutter 75, and a pre-feeder 77. Processes performed by the printer 76, the sheet cutter 71, the absorption stopper 72, the feeder 73, the absorption driver 74, the medium cutter 75 and the pre-feeder 77 will be described below.

The elements included in the controller 70 may be realized by software. Namely, a computer program may be read into a computer, so that the computer realizes the above-described elements. Preferred embodiments of the present invention include a computer program that causes the computer to act as each of the above-described elements. Also, preferred embodiments of the present invention include a computer-readable storage medium having such a computer program stored thereon. The above-described elements may each be a processor realized by execution of the computer program stored on the controller 70. In this case, each of the above-described elements may be realized by one processor or a plurality of processors. Preferred embodiments of the present invention include a circuit that realizes a function substantially the same as that of the program executed by each of the elements.

Figure 11:
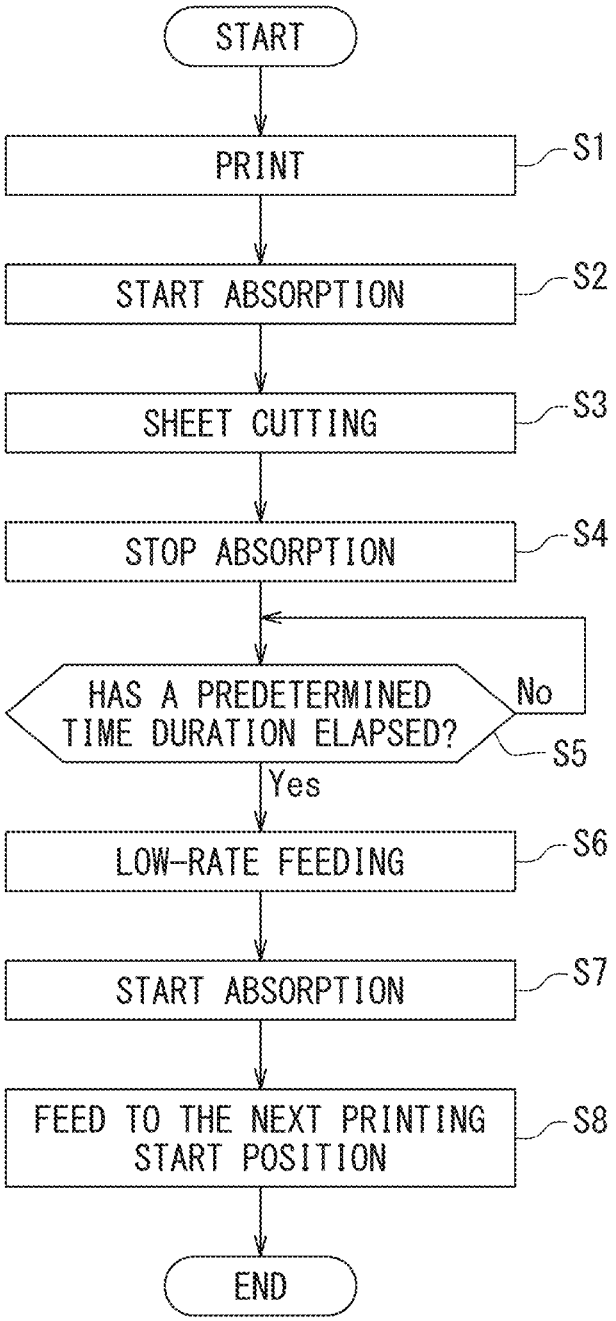
FIG. 11 is a flowchart illustrating an example of operation of the printer/medium cutting device.

FIG. 11 is a flowchart illustrating an example of operation of the printer device 10. Now, an example of operation of the printer device 10 will be described with reference to FIG. 11.

First, the printer 76 performs printing on the medium Me (step S1). The printer 76 repeats an injection operation of causing the printing heads 12A to inject ink while moving the carriage 12 in the left-right direction in a state where the transportation of the medium Me is stopped, and a feed operation of rotating the feed roller 61 to transport the medium Me forward (in the downstream direction) by a predetermined length. The printer 76 repeats the injection operation and the feed operation to form an image on the medium Me. Hereinafter, a rate at which the medium Me is transported forward during the feed operation in the printing will be referred to as "printing feed rate V1". There is no specific limitation on the value of the printing feed rate V1. The printing feed rate V1 is, for example, about 1 mm/sec to about 30 mm/sec.

Figure 12A:
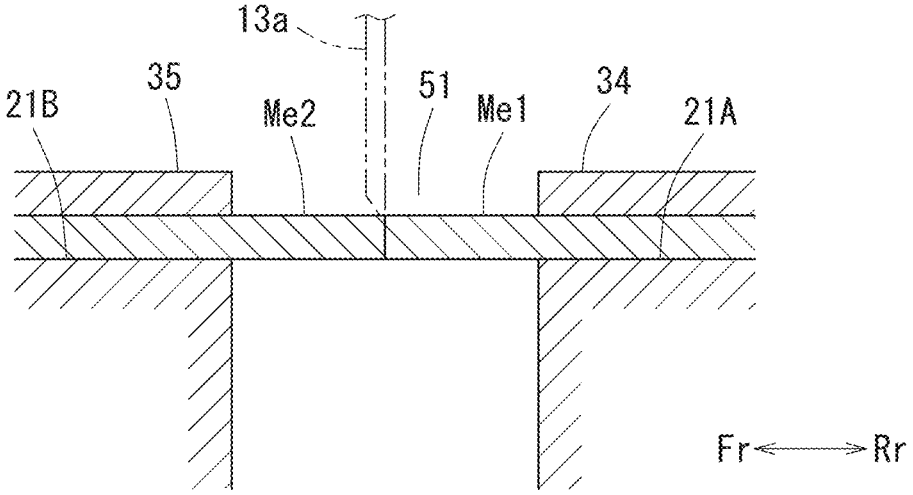
FIG. 12A is a cross-sectional view of the clamp, a medium and the table in a state where the medium is cut into a plurality of post-cutting mediums.

When the printing is finished, the sheet cutter 71 performs sheet cutting of cutting the medium Me in the entirety of the left-right direction thereof. The sheet cutter 71 first starts driving the fan 83 to cause the medium Me to adsorb to the table (step S2). Namely, the sheet cutter 71 starts absorbing the medium Me. Next, the carriage driving motor 81 is driven to move the blade 13*a* of the cutting mechanism 13 along the groove 22. As a result, a rear area (namely, upstream-side area) of a printed area (area where the image has been printed) of the medium Me is cut in the entirety of the left-right direction thereof (step S3). FIG. 12A is a side view of the post-cutting medium Me. The medium Me is pressed onto the table 20 by the first clamp portion 34 and the second clamp portion 35 of the clamp 30, and therefore, is prevented from rising from the table 20. For this reason, the medium Me is cut in a favorable manner. Hereinafter, an upstream-side area of the post-cutting medium Me will be referred to as a "first medium Me1", and a downstream-side area of the post-cutting medium Me will be referred to as a "second medium Me2".

After the sheet cutting, the absorption stopper 72 stops the fan 83 (step S4), and the feeder 73 drives the feed motor 82 to feed the first medium Me1 forward. The feeder 73 may start driving the feed motor 82 at the same time as a driving signal to the fan 83 stops being supplied. However, there may be a case where even though the supply of the driving signal is stopped, it takes some time for the fan 83 to stop rotating. Therefore, in this preferred embodiment, the feeder 73 determines whether or not a predetermined time (e.g., 2 seconds) has elapsed after the stop, by the absorption stopper 72, of the supply of a driving signal to the fan 83 (step S5), and starts driving the feed motor 82 after the elapse of the predetermined time (step S6). With such an arrangement, the feed roller 61 starts rotating after an adsorption force to the second medium Me2 is sufficiently extinct.

Figure 13:
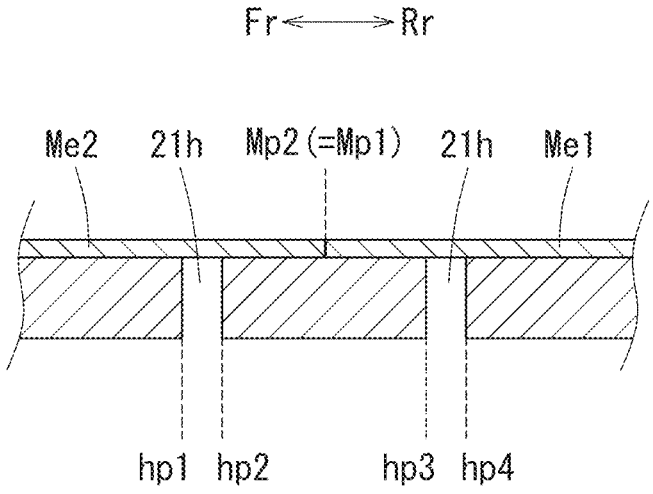
FIG. 13 is a cross-sectional view of the medium and the table.

The feeder 73 controls the feed motor 82 to stop transporting the first medium Me1 in a state where a portion of the second medium Me2 is located above at least a portion of the adsorption holes 21*h*. In this preferred embodiment, the adsorption holes 21*h* are provided in two lines, namely, a front line and a rear line, extending in the left-right direction. In the front-rear direction, there are two adsorption holes 21*h*. As shown in FIG. 13, the feeder 73 controls the feed motor 82 to stop transporting the first medium Me1 in a state where an upstream-side end Mp2 of the second medium Me2 is located upstream with respect to a downstream-side end hp1 of the adsorption holes 21*h* located at the most downstream position (in this example, the front adsorption holes 21*h*). It is preferred that when the transportation of the first medium Me1 is stopped, the upstream-side end Mp2 of the second medium Me2 is located upstream with respect to an upstream-side end hp2 of the adsorption holes 21*h* located at the most downstream position. When the transportation of the first medium Me1 is stopped, the upstream-side end Mp2 of the second medium Me2 may be located upstream with respect to a downstream-side end hp3 of the adsorption holes 21*h* located at the most upstream position (in this example, the rear adsorption holes 21*h*), or may be located upstream with respect to an upstream-side end hp4 of the adsorption holes 21*h* located at the most upstream position.

In this preferred embodiment, when the feeder 73 stops transporting the first medium Me1, a downstream-side end Mp1 of the first medium Me1 is located downstream with respect to the upstream-side end hp4 of the adsorption holes 21*h* located at the most upstream position. Namely, the feeder 73 controls the feed motor 82 to stop transporting the first medium Me1 in a state where a portion of the first medium Me1 is located above at least a portion of the adsorption holes 21*h*. However, there is no specific limitation on the position of the downstream-side end Mp1 of the first medium Me1 when the transportation of the first medium Me1 is stopped. When the feeder 73 stops transporting the first medium Me1, the downstream-side end Mp1 of the first medium Me1 may be located upstream with respect to the upstream-side end hp4 of the adsorption holes 21*h* located at the most upstream position.

Figure 12B:
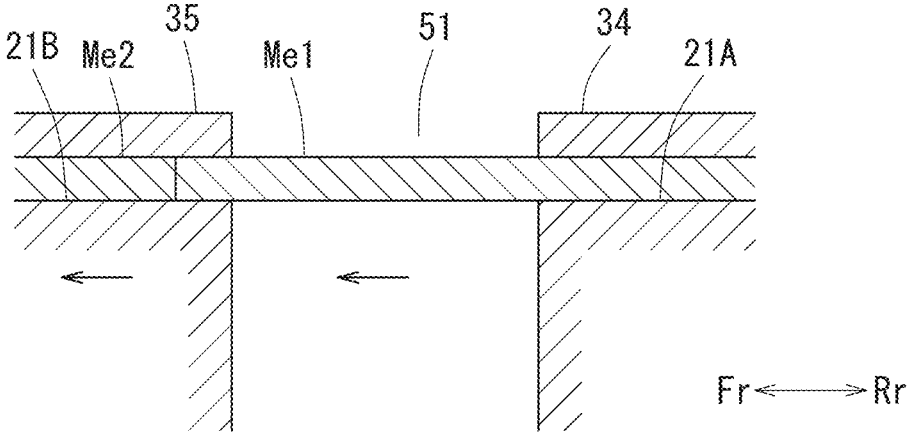
FIG. 12B is a cross-sectional view thereof in a state where the post-cutting mediums are transported.

The feeder 73 rotates the feed roller 61 at a relatively low rate. Where the transportation rate of the first medium Me1 in this case is referred to as "low-rate feed rate V2", low-rate feed rate V2 is lower than printing feed rate V1 described above. In the case where printing feed rate V1 is variable, low-rate feed rate V2 is lower than a maximum value (hereinafter, referred to as the "maximum rate") of printing feed rate V1. There is no specific limitation on the value of low-rate feed rate V2. Low-rate feed rate V2 is, for example, about 10 mm/sec. As shown in FIG. 12B, when the first medium Me1 is transported forward by the feed roller 61, the second medium Me2 is pushed forward by the first medium Me1. As a result, the second medium Me2 and the first medium Me1 are transported forward continuously.

Figure 12C:
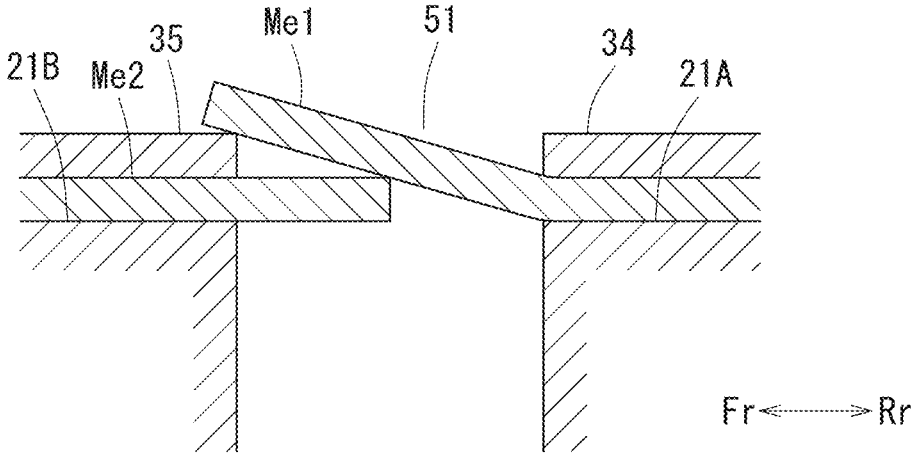
FIG. 12C is a cross-sectional view thereof in a state where one of the post-cutting mediums rides on the other of the post-cutting mediums.

The clamp 30 includes a gap 51 between the first clamp portion 34 and the second clamp portion 35. Therefore, in the case where the adsorption force to the second medium Me2 remains, or in the case where the transportation rate of the first medium Me1 is relatively high, as shown in FIG. 12C, the first medium Me1 may undesirably ride on the second medium Me2. However, according to this preferred embodiment, when the feed motor 82 starts being driven, the adsorption force to the second medium Me2 is sufficiently extinct, and the transportation rate of the first medium Me1 is relatively low. Therefore, the first medium Me1 is prevented from riding on the second medium Me2. Thus, the first medium Me1 and the second medium Me2 are transported in a favorable manner (see FIG. 12B).

As shown in FIG. 1, the table 20 of the printer device 10 is open forward. The table 20 is located at a level higher than the floor. A front end of the table 20 is located at a level higher than a region of the printer device 10 that is to the front of the table 20. The region to the front of the front end of the table 20 and a region to the rear of the front end of the table 20 are different in terms of the level. Therefore, when the second medium Me2, which has been cut off from the first medium Me1, is fed forward, the second medium Me2 drops from the table 20 by the weight thereof if no measure is taken. In this preferred embodiment, in order to avoid such a situation, the feed roller 61 is rotated at a low rate to transport the first medium Me1 and the second medium Me2 forward, and then the absorption driver 74 drives the fan 83 to cause the second medium Me2 to adsorb to the second top surface 21B of the table 20 (step S7). In this preferred embodiment, the absorption driver 74 drives the fan 83 in a state where a portion of the second medium Me2 is located above at least a portion of the adsorption holes 21*h* (see FIG. 13). With such an arrangement, the second medium Me2 is held to a front portion of the table 20 and thus is prevented from dropping.

In the case where a portion that accommodates the second medium Me2 is provided below the table 20, or in the case where there is no problem even if the second medium Me2 drops, the operation of causing the second medium Me2 to adsorb to the table 20 is not necessary. In this case, the process in step S7 may be omitted.

After this, the feed motor 82 is driven to transport the first medium Me1 forward until a front end of the first medium Me1 reaches the next printing start position (step S8). This is a first example of operation of the printer device 10.

The above-described sheet cutting is an operation of moving the cutter 13*a* in the left-right direction in a state where the transportation of the medium Me is stopped and cutting the medium Me along a straight line in the left-right direction. The printer device 10 according to this preferred embodiment may, in addition to performing the sheet cutting, combine the operation of moving the cutter 13*a* in the left-right direction and the operation of transporting the medium Me forward or rearward and thus cut the medium Me in the front-rear direction and the left-right direction. In order to be distinguished from the sheet cutting, the operation of cutting the medium Me while transporting the medium Me forward or rearward will be referred to as "medium cutting". For example, the printer device 10 may cut a medium Me having printing not performed thereon into an optional two-dimensional shape by the medium cutting. The printer device 10 may print an image on the medium Me and then cut the medium Me along a periphery of the printed image.

Figure 14:
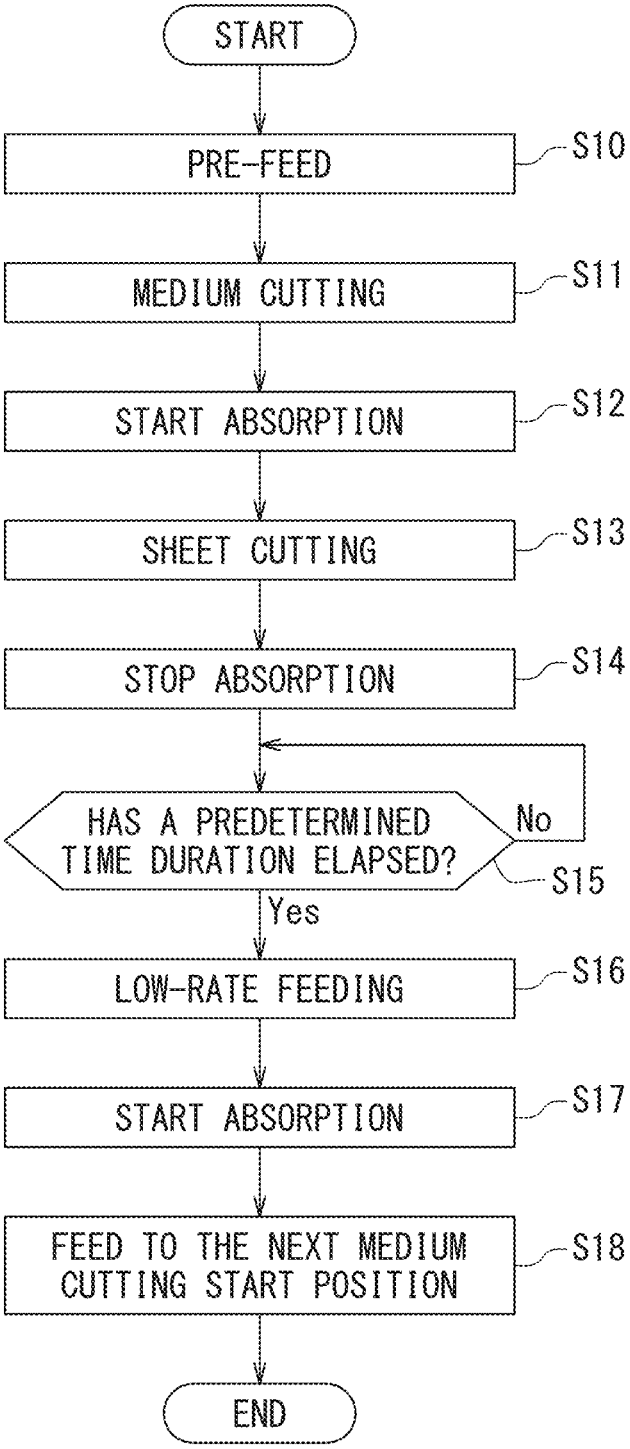
FIG. 14 is a flowchart illustrating another example of operation of the printer/medium cutting device.

Now, with reference to FIG. 14, another example of operation of the printer device 10 will be described. Although not shown, in this example of operation, the medium Me has a structure in which a mounting sheet, an adhesive and a surface material are stacked. In the following description, the mounting sheet will be referred to as a "bottom layer", and a layer including the adhesive and the surface material will be referred to as a "top layer". The printer device 10 cuts the top layer and the bottom layer for sheet cutting, and cuts only the top layer but does not cut the bottom layer for medium cutting.

First, the pre-feeder 77 (see FIG. 10) controls the feed motor 82 to execute pre-feed of transporting the medium Me in the downstream direction and the upstream direction prior to the medium cutting (step S10). In this example, the pre-feeder 77 transports the medium Me in the downstream direction, and then in the upstream direction. There is no specific limitation on the value of transportation rate V4 of the medium Me during the pre-feed. Transportation rate V4 is, for example, about 50 mm/sec. Transportation rate V4 of the medium Me during the pre-feed may be constant or variable.

Next, the medium cutter 75 (see FIG. 10) executes the medium cutting of performing, at the same time, the operation of causing the cutter 13*a* to cut medium Me and the feed operation of causing the feed motor 82 to transport the medium Me forward or rearward (step S11). As a result of the medium cutting, the top layer of the medium Me is cut into a predetermined two-dimensional shape. There is no specific limitation on transportation rate V3 of the medium Me during the medium cutting. Transportation rate V3 is, for example, about 1 mm/sec to about 30 mm/sec.

When the medium cutting is finished, the sheet cutter 71 performs the sheet cutting. The sheet cutter 71 starts driving the fan 83 to cause the medium Me to adsorb to the table 20 (step S12). Next, the carriage driving motor 81 is driven to move the cutter 13*a* along the groove 22. As a result, the top layer and the bottom layer of the medium Me are cut in the entirety of the left-right direction thereof (step S13). The medium Me is divided into the first medium Me1, which is the upstream-side area, and the second medium Me2, which is an the downstream-side area.

After the sheet cutting, the absorption stopper 72 stops the fan 83 (step S14), and the feeder 73 drives the feed motor 82 to feed the first medium Me1 forward. In this example of operation also, the feeder 73 determines whether or not a predetermined time (e.g., 2 seconds) has elapsed after the stop, by the absorption stopper 72, of the supply of a driving signal to the fan 83 (step S15), and starts driving the feed motor 82 after the elapse of the predetermined time (step S16). With such an arrangement, the feed roller 61 starts rotating after an adsorption force to the second medium Me2 is sufficiently extinct.

The feeder 73 controls the feed motor 82 to stop transporting the first medium Me1 like in operation example 1 described above. The operation by which the feeder 73 stops transporting the first medium Me1 is substantially the same as that in operation example 1 and thus will not be described in detail.

In this example of operation also, the feeder 73 rotates the feed roller 61 at a relatively low rate. The transportation rate of the first medium Me1 in this case (i.e., low-rate feed rate V2) is lower than maximum transportation rate V3 of the medium Me during the sheet cutting. Low-rate feed rate V2 is lower than maximum transportation rate V4 of the medium Me during the pre-feed. Low-rate feed rate V2 is, for example, 10 mm/sec. In this example of operation also, the first medium Me1 is prevented from riding on the second medium Me2. Thus, the first medium Me1 and the second medium Me2 are transported in a favorable manner (see FIG. 12B).

In this example of operation also, the feed roller 61 is rotated at a low rate to transport the first medium Me1 and the second medium Me2 forward, and then the absorption driver 74 drives the fan 83 to cause the second medium Me2 to adsorb to the second top surface 21B of the table 20 (step S17). With such an arrangement, the second medium Me2 is held to the front portion of the table 20 and thus is prevented from dropping.

After this, the feed motor 82 is driven to transport the first medium Me1 forward until the front end of the first medium Me1 reaches the next medium cutting position (step S18). This is a second example of operation of the printer device 10.

The clamp 30 and the printer device 10 according to this preferred embodiment provide various effects. Now, the effects provided by the clamp 30 and the printer device 10 according to this preferred embodiment will be described.

Figure 5:
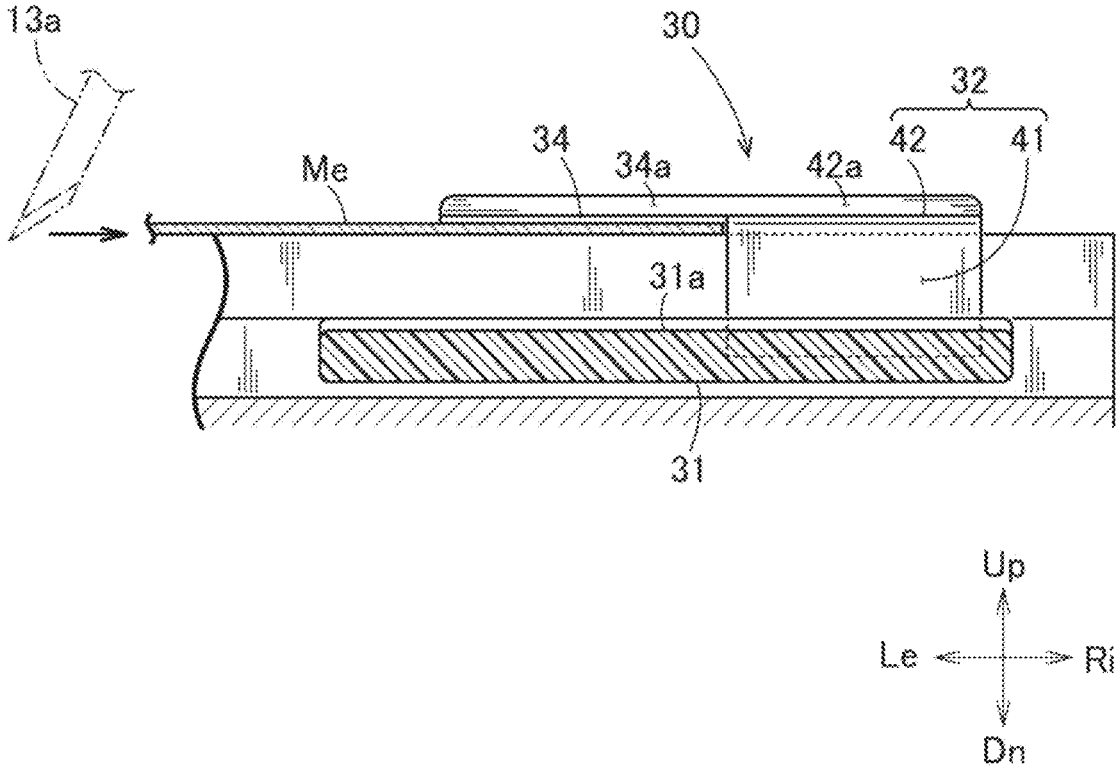
FIG. 5 is a cross-sectional view taken along line 5-5 in FIG. 3.

As shown in FIG. 3, the clamp 30 includes the first clamp portion 34 urging the medium Me toward the first top surface 21A and the second clamp portion 35 urging the medium Me toward the second top surface 21B, and also includes the gap 51 located above the groove 22 of the table 20, the gap 51 being provided between the first clamp portion 34 and the second clamp portion 35. Therefore, the medium Me is pressed so as not to rise from the table 20, and the blade 13*a* of the cutter mechanism 13 is moved along the groove 22 to the end of the medium Me. The medium Me is cut along the groove 22 while being clamped by the clamp 30. Even when the medium Me is to be cut in the entirety of the width direction (left-right direction) thereof, the blade 13*a* of the cutter mechanism 13 and the clamp 30 are prevented from interfering with each other (see FIG. 5). Therefore, the clamp 30 does not need to be detached from the table 20 in order to avoid the interference. Even without the clamp 30 being detached from the table 20, the blade 13*a* is allowed to move from one end to the other end of the medium Me in the width direction thereof. For this reason, the operation of cutting the medium Me is made easy, and the time duration required for the cutting operation is shortened. As can be seen, the medium Me is prevented from rising, and the operation of cutting the medium Me is performed easily and quickly.

The clamp 30 further includes the gap 52 located above the groove 22, the gap 52 being located between the first rising portion 41 and the second rising portion 46. The blade 13*a* of the cutter mechanism 13 also passes between the first rising portion 41 and the second rising portion 46. Therefore, the blade 13*a* moves along the groove 22 in the entirety of the left-right direction of the clamp 30.

As shown in FIG. 2, the cutter mechanism 13 is movable up to a home position, which is to the right of the table 20. Namely, the cutter mechanism 13 is movable to positions outer to the clamps 30 in the left-right direction. According to this preferred embodiment, the cutter mechanism 13 pivots the blade 13*a* upward after passing through the clamp 30 and reaching the home position.

Any of various specifications of medium Me is usable for the printer device 10. Any of a plurality of types of medium Me having different widths is usable for the printer device 10, and the position in the left-right direction of the clamp 30 is changed in accordance with the width of the medium Me. In the case where a medium Me having a relatively small width is used, the distance between the left and right clamps 30 is shortened. Either one of the left and right clamps 30 is set at a position close to the center of the table 20 in the left-right direction. According to this preferred embodiment, the blade 13*a* is movable along the groove 22 in the entirety of the left-right direction of the clamp 30. Therefore, even if the clamp 30 is located at a position close to the center of the table 20 in the left-right direction, the blade 13*a* does not interfere with the clamp 30. The clamps 30 may be set at any positions instead of left and right ends of the groove 22.

The base portion 31 may be integral with the first member 32 and the second member 33. In this preferred embodiment, the base portion 31 is formed separately from the first member 32 and the second member 33. According to this preferred embodiment, the base portion 31 supports the first member 32 and the second member 33, so that the first member 32 and the second member 33 are located at accurate positions. Therefore, even if the groove 22 is narrow, the gap 51 having a predetermined width is accurately formed between the first clamp portion 34 and the second clamp portion 35, and the gap 52 having a predetermined width is accurately formed between the first rising portion 41 and the second rising portion 46. For this reason, the blade 13*a* of the cutter mechanism 13 passes along the gaps 51 and 52 without fail.

As shown in FIG. 6A, the first member 32 and the second member 33 supported by the base portion 31 preferably are generally L-shaped so as to apply an urging force to the first top surface 21A and the second top surface 21B respectively when being attached to the table 20. However, even if angle θ1 defined by the first member 32 and the second member 33 is slightly different from a predetermined angle, the urging force is applied to the first top surface 21A and the second top surface 21B. This makes it easy to manage the sizes.

The base portion 31 is preferably made of a hard resin. This allows the base portion 31 to slide along the groove 22 easily in a state where the base portion 31 is located in the groove 22. The clamp 30 is easily movable along the groove 22, and therefore, the position of the clamp 30 is easily adjustable.

As shown in FIG. 3, the clamp 30 according to this preferred embodiment includes the first spacer 36 provided on the bottom surface of the first extending portion 42 and the second spacer 37 provided on the bottom surface of the second extending portion 47. With this structure, a gap into which the medium Me is transportably insertable is accurately formed between the first clamp portion 34 and the first top surface 21A and between the second clamp portion 35 and the second top surface 21B. In addition, the first extending portion 42 and the first clamp portion 34 are prevented from directly contacting the first top surface 21A, and the second extending portion 47 and the second clamp portion 35 are prevented from directly contacting the second top surface 21B. The size of an area along which the clamp 30 and the table 20 are in contact with each other is decreased. Therefore, when the clamp 30 is sliding, a resistance against the sliding operation is decreased. This guarantees a high level of operability of the clamp 30. In order to further decrease the resistance against the sliding operation, the first spacer 36 may be formed of a material that is more slippery than the first member 32, and the second spacer 37 may be formed of a material that is more slippery than the second member 33.

In the clamp 30 according to this preferred embodiment, as shown in FIG. 8C, length L5 in the left-right direction of the base portion 31 is longer than total length L6 in the left-right direction of the first extending portion 42 and the first clamp portion 34, and is also longer than total length L7 in the left-right direction of the second extending portion 47 and the second clamp portion 35. Therefore, while the clamp 30 is sliding along the groove 22, the inclination of the base portion 31 inside the groove 22 is decreased (see FIG. 8D). Therefore, while the clamp 30 is sliding, the base portion 31 is prevented from acting as a resistance against the sliding operation. This guarantees a high level of operability of the clamp 30.

As shown in FIG. 4, in the printer device 10 according to this preferred embodiment, the groove 22 includes the first (rear) pullout-preventive wall portion 22Bd protruding toward the second (front) side wall portion 22C more than the first (rear) accommodation portion 22Bb and the second (front) pullout-preventive wall portion 22Cd protruding toward the first (rear) side wall portion 22B more than the second (front) accommodation portion 22Cb. Therefore, the base portion 31 is prevented from being pulled upward out of the groove 22, and thus the medium Me is clamped more certainly.

In the printer device 10 according to this preferred embodiment, the fan 83 is stopped after the sheet cutting, and the medium Me is transported. After this, the fan 83 is re-driven in a state where a portion of the second medium Me2 is located above at least a portion of the adsorption holes 21*h*. This allows at least the portion of the second medium Me2 to be held on the table 20. Therefore, the second medium Me2 is prevented from dropping from the table 20 by the weight thereof. The second medium Me2, on which printing or the like has been performed, is recovered in a favorable state without being damaged.

In the printer device 10 according to this preferred embodiment, the controller 70 includes the absorption stopper 72 stopping the fan 83 after the sheet cutting, and the feeder 73 driving the feed motor 82 after the fan 83 is stopped (see FIG. 10). Therefore, although the gap 51 is provided between the first clamp portion 34 and the second clamp portion 35 of the clamp 30, the post-cutting first medium Me1 is prevented from riding on the post-cutting second medium Me2 (see FIG. 12C) while the post-cutting first medium Me1 and the post-cutting second medium Me2 are transported forward. This allows the post-cutting first medium Me1 and the post-cutting second medium Me2 to be transported in a favorable manner.

In the printer device 10 according to this preferred embodiment, the feeder 73 controls the feed motor 82 to start moving the medium Me when a predetermined time elapses after the finish of the sheet cutting. Therefore, the medium Me is transported after the adsorption force provided by the fan 83 is sufficiently extinct. This allows the post-cutting first medium Me1 and the post-cutting second medium Me2 to be transported in a favorable manner.

In the printer device 10 according to this preferred embodiment, rate V2, at which the feeder 73 transports the medium Me, is lower than rate V1 (maximum rate V1), at which the printer 76 transports the medium Me. Namely, transportation rate V2 of the medium Me after the sheet cutting is lower than transportation rate V1 of the medium Me during the printing. Transportation rate V2 of the medium Me after the sheet cutting is lower than maximum transportation rate V3 of the medium Me during the medium cutting. Transportation rate V2 of the medium Me after the sheet cutting is lower than maximum transportation rate V4 of the medium Me during the pre-feed. The medium Me is transported at a relatively low rate after the sheet cutting, and therefore, the first medium Me1 is prevented from riding on the second medium Me2 (see FIG. 12C). This allows the post-cutting first medium Me1 and the post-cutting second medium Me2 to be transported in a favorable manner.

The printer device 10 according to this preferred embodiment includes the clamp 30 attachable to the table 20. The clamp 30 presses the medium Me onto the first top surface 21A and the second top surface 21B of the table 20. Therefore, the medium Me is prevented from rising from the table 20, and the above-described operations are performed in a favorable manner.

Preferred Embodiment 2

Figure 15:
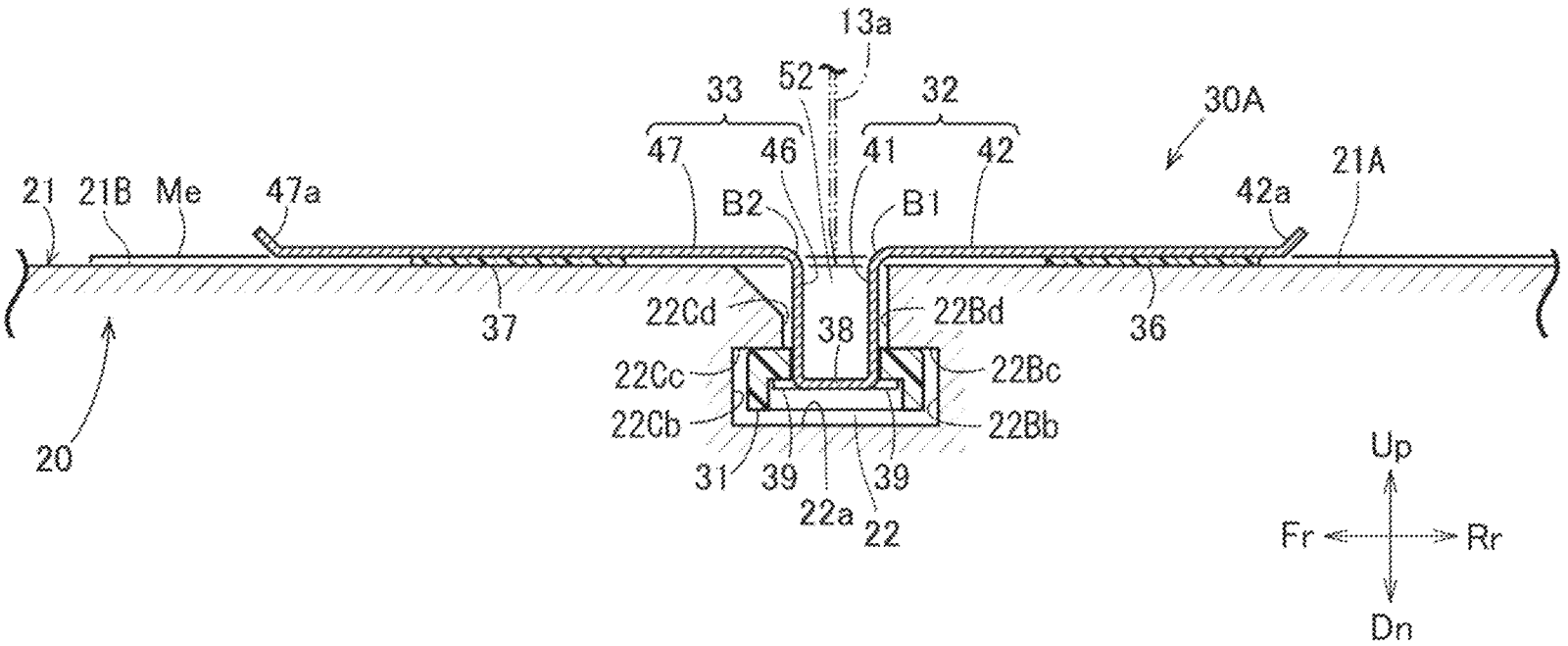
FIG. 15 is a view, corresponding to FIG. 4, of a clamp according to preferred embodiment 2 of the present invention.
Figure 16:
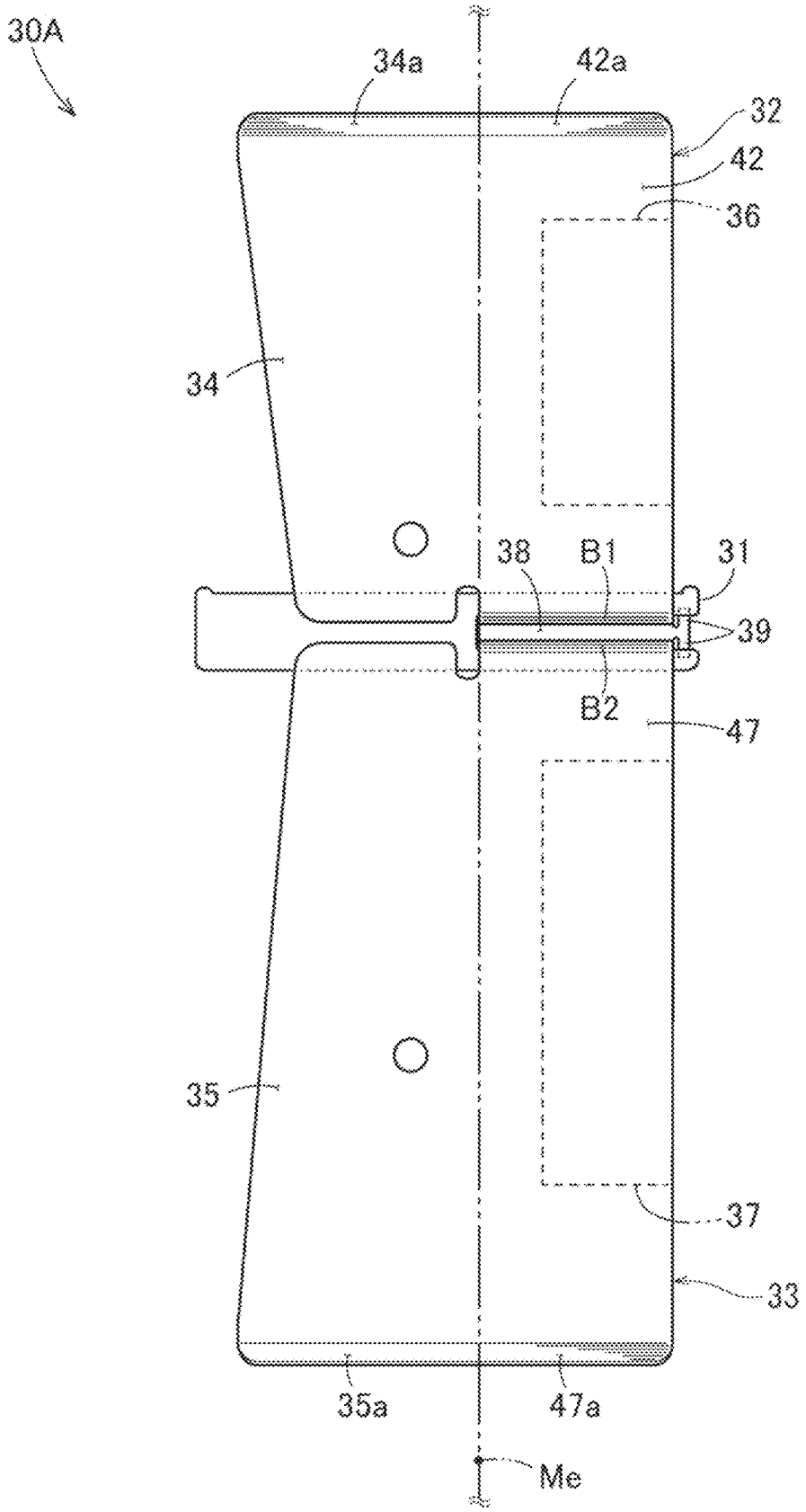
FIG. 16 is a plan view of the clamp according to preferred embodiment 2 of the present invention.

A clamp according to another preferred embodiment of the present invention will be described. The operation of the printer device 10 is substantially the same as that in preferred embodiment 1, and thus will not be described. FIG. 15 is a cross-sectional view of a clamp 30A according to preferred embodiment 2, and FIG. 16 is a plan view or the clamp 30A. In the clamp 30A according to preferred embodiment 2 also, the first member 32 and the second member 33 are defined by a single unitary metal plate. The other basic elements are also substantially the same as those of the clamp 30 in preferred embodiment 1. Thus, in the following description, portions substantially the same as, or corresponding to, those in preferred embodiment 1 will bear the same reference signs thereto, and descriptions thereof will be omitted.

In the clamp 30A according to this preferred embodiment, a bottom end of the first rising portion 41 and a bottom end of the second rising portion 46 are connected with each other by a connection portion 38. In addition, a front end of the connection portion 38 protrudes forward, and a rear end of the connection portion 38 protrudes rearward. The front end and the rear end of the connection portion 38 act as pullout-preventive portions 39 preventing the connection portion 38 from being pulled out of the base portion 31.

Figure 6D:
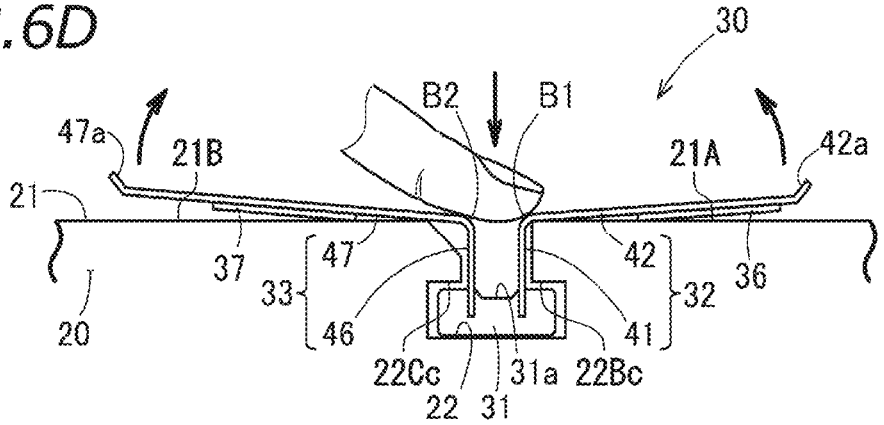
FIG. 6D is a side view of the clamp and the table in a state where a portion of the clamp is pushed by a fingertip.

In this preferred embodiment also, when the borders B1 and B2 are pressed downward, the tip portions 34*a* and 35*a* of the first clamp portion 34 and the second clamp portion 35 move upward (see FIG. 6D). In this preferred embodiment, the tip portions 34*a* and 35*a* of the first clamp portion 34 and the second clamp portion 35 move upward especially easily. Namely, when the borders B1 and B2 are pressed downward, a gap in the up-down direction between the first clamp portion 34 and the first top surface 21A and a gap in the up-down direction between the second clamp portion 35 and the second top surface 21B are easily enlarged.

As shown in FIG. 16, side surfaces of the first extending portion 42 and the second extending portion 47 are parallel to the transportation direction of the medium Me. By contrast, side surfaces of the first clamp portion 34 and the second clamp portion 35 are inclined with respect to the transportation direction of the medium Me. The side surface of the first clamp portion 34 is inclined so as to be closer to the first extending portion 42 as being closer to the base portion 31. The side surface of the second clamp portion 35 is inclined so as to be closer to the second extending portion 47 as being closer to the base portion 31. The first clamp portion 34 increases in the length in the left-right direction as being closer to the tip portion 34*a*, and the second clamp portion 35 increases in the length in the left-right direction as being closer to the tip portion 35*a*. When the borders B1 and B2 are pressed, the gap in the up-down direction between the first clamp portion 34 and the first top surface 21A enlarges as being closer to the tip portion 34*a*, and the gap in the up-down direction between the second clamp portion 35 and the second top surface 21B enlarges as being closer to the tip portion 35*a*. Namely, the first clamp portion 34 and the second portion 35 are longer in the left-right direction in the portions that are more distanced in the up-down direction from the table 20, namely, in the portions that are closer to the tip portions 34*a* and 35*a*, than in the portions that are closer to the base portion 31. Therefore, when the clamp 30A is to be attached to the table 20, the medium Me may be moved in the left-right direction while the borders B1 and B2 are pressed. In this manner, the medium Me first enters larger portions of the gap between the clamp 30A and the table 20 (portions of the gap that are closer to the tip portions 34*a* and 35*a*).

In the clamp 30 according to preferred embodiment 1 (see FIG. 4), a stress tends to concentrate to the base portion 31 at the bottom end of the first rising portion 41 and the bottom end of the second rising portion 46. Therefore, if the portions of the first rising portion 41 and the second rising portion 46 that are buried in the base portion 31 are short, the first member 32 and the second member 33 may undesirably wobble with respect to the base portion 31. By contrast, in the clamp 30A according to preferred embodiment 2, as shown in FIG. 15, the bottom end of the first rising portion 41 and the bottom end of the second rising portion 46 are connected with each other by the connection portion 38. The first rising portion 41, the connection portion 38 and the second rising portion 46 are integrally formed. The bottom end of the first rising portion 41 and the bottom end of the second rising portion 46 are also connected with the base portion 31. Therefore, the stress at the bottom ends of the first rising portion 41 and the second rising portion 46 is dispersed, and a load applied to the base portion 31 is alleviated. This prevents the clamp 30A from wobbling.

Although not described in detail, also in the case where the clamp 30A according to preferred embodiment 2 is attached to the table 20 of the printer device 10, the above-described operations of the printer device 10 are performed. Therefore, the clamp 30A prevents the medium Me from rising, and the operation of cutting the medium Me is performed easily and quickly. In addition, the post-cutting first medium Me1 is prevented from riding on the post-cutting second medium Me2. This allows the post-cutting first medium Me1 and the post-cutting second medium Me2 to be transported in a favorable manner. The above-described effects are also provided.

As shown in FIG. 16, in the clamp 30A according to preferred embodiment 2, the first clamp portion 34 decreases in the length in the left-right direction as being closer to the base portion 31 from the tip portion 34*a*. The area size of the first clamp portion 34 per unit length along the transportation direction of the medium Me is smaller in a portion thereof closer to the base portion 31 than a portion thereof closer to the tip portion 34*a*. Similarly, the second clamp portion 35 decreases in the length in the left-right direction as being closer to the base portion 31 from the tip portion 35*a*. The area size of the second clamp portion 35 per unit length along the transportation direction of the medium Me is smaller in a portion thereof closer to the base portion 31 than a portion thereof closer to the tip portion 35*a*. With such a structure, a local force by which each of the first clamp portion 34 and the second clamp portion 35 presses the medium Me is weakened as being closer to the base portion 31. For this reason, while the post-cutting medium Me is transported, the first medium Me1 overlaps the second medium Me2 more easily in the clamp 30A according to preferred embodiment 2 than in the clamp 30 according to preferred embodiment 1. Therefore, the above-described effect of control by the controller 70, namely, the effect of preventing the mediums Me1 and Me2 from overlapping each other is more conspicuous.

Preferred Embodiment 3

Now, a clamp and a printer device according to preferred embodiment 3 of the present invention will be described. In the following description, portions substantially the same as, or corresponding to, those in preferred embodiment 1 will bear the same reference signs thereto, and descriptions thereof will be omitted.

Figure 17:
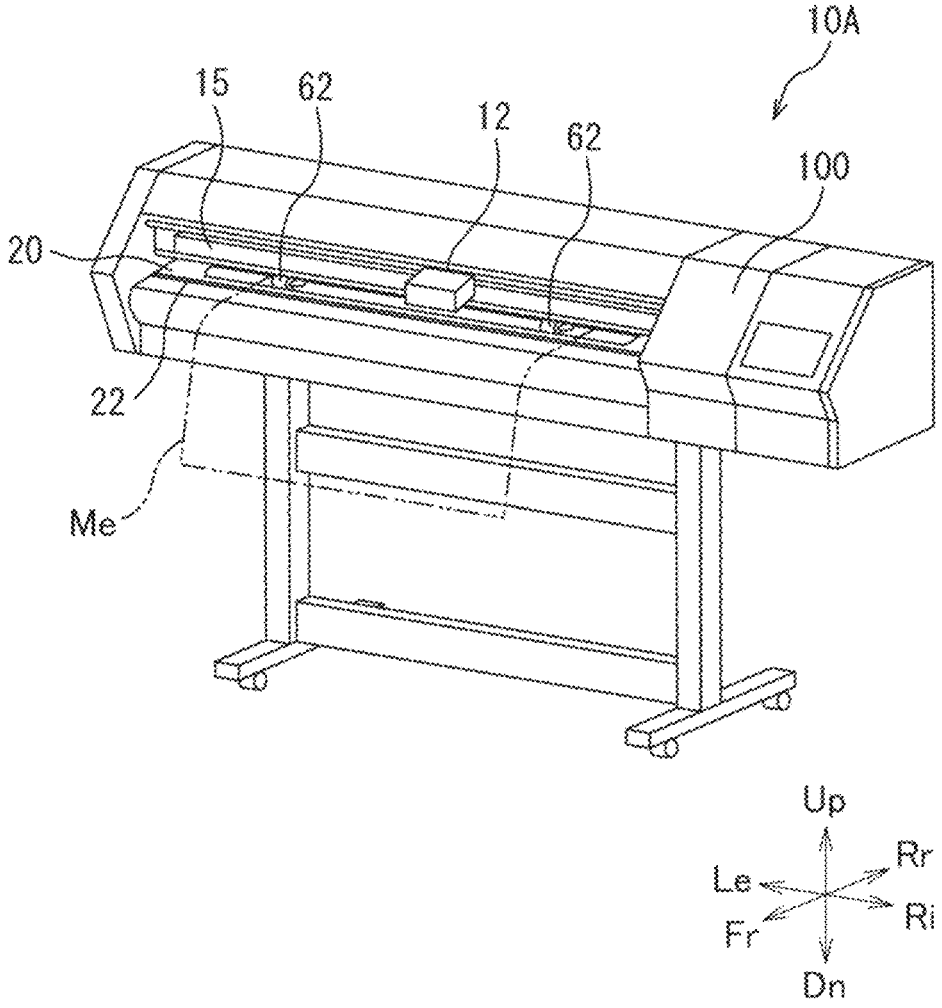
FIG. 17 is a perspective view of a printer/medium cutting device according to preferred embodiment 3 of the present invention.
Figure 18:
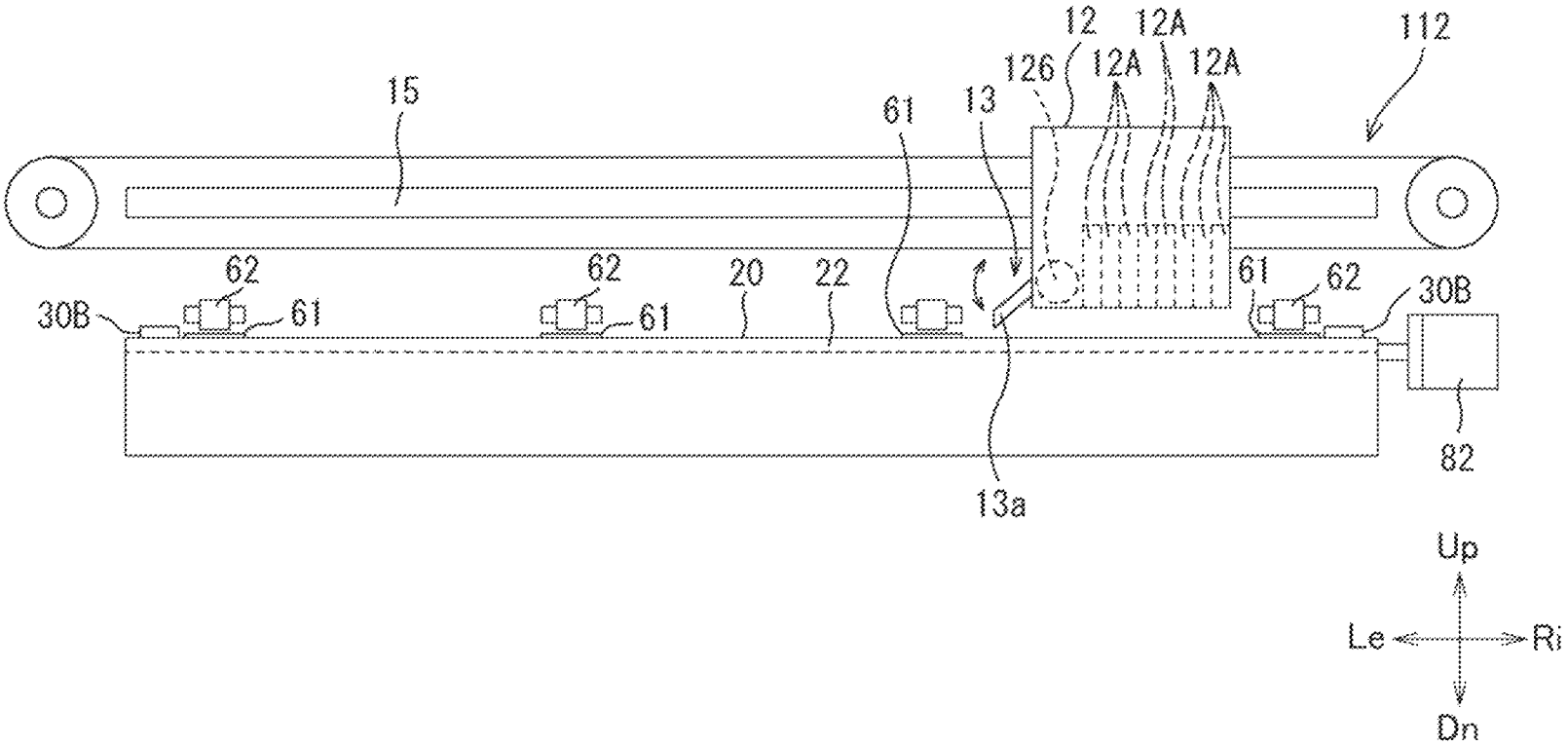
FIG. 18 is a partial front view of the printer/medium cutting device according to preferred embodiment 3 of the present invention.
Figure 19:
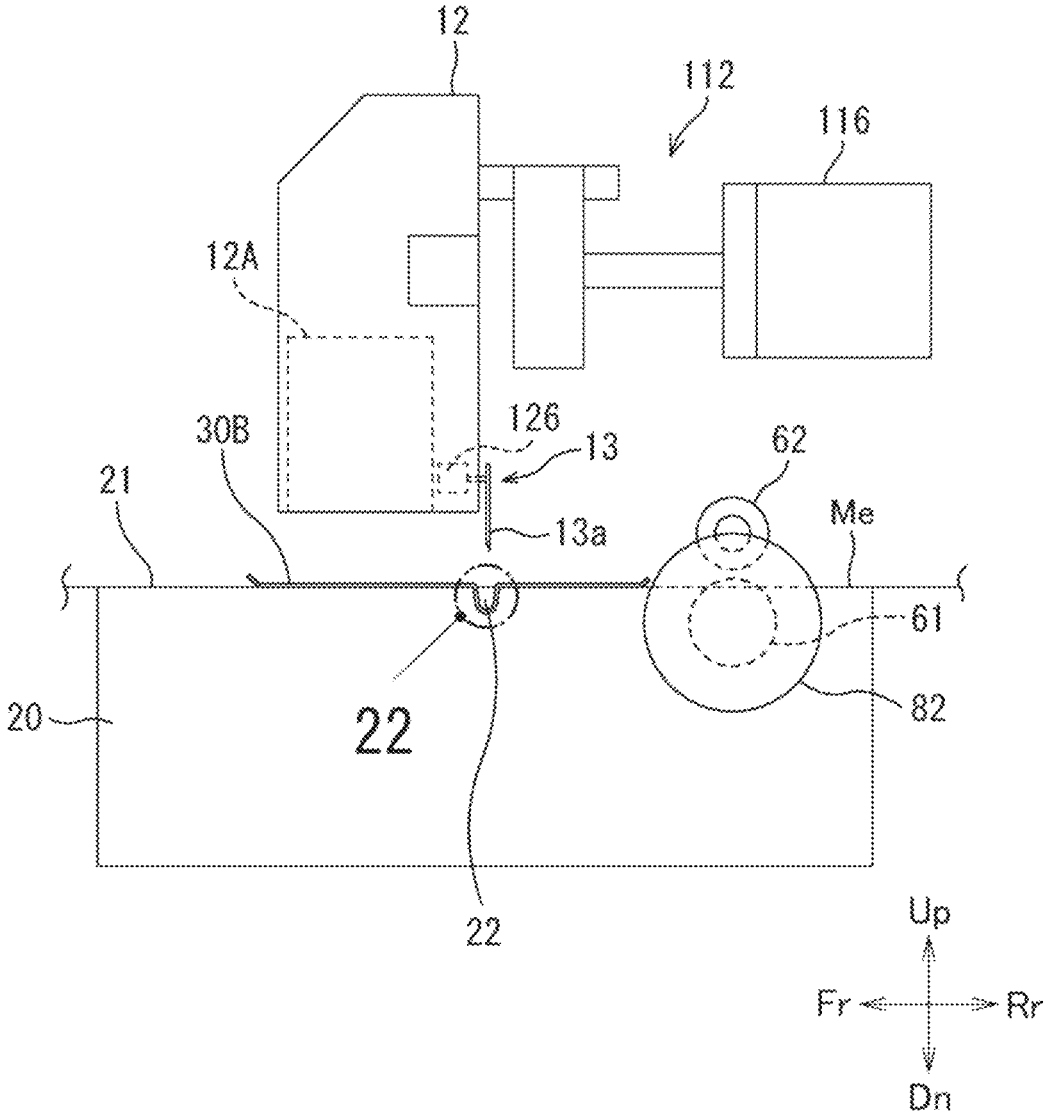
FIG. 19 is a partial side view of the printer/medium cutting device according to preferred embodiment 3 of the present invention.

FIG. 17 is a perspective view of a printer device 10A, FIG. 18 is a front view of elements of the printer device 10A, and FIG. 19 is a side view of the elements of the printer device 10A.

As shown in FIG. 17 and FIG. 18, the printer device 10A includes the carriage 12 accommodating the printing heads 12A and the cutting mechanism 13, a housing 100, the table 20, and a pair of, more specifically, left and right, clamps 30B attachable to, and detachable from, the table 20. FIG. 17 shows a state where the table 20 has no clamp 30B attached thereto. FIG. 18 and FIG. 19 shows a state where the clamps 30B are attached to the table 20 (FIG. 19 shows only one clamp 30B).

As shown in FIG. 18 and FIG. 19, the printer device 10A includes the guide rail 15, a carriage driving mechanism 112, the feed rollers 61, the feed motor 82, and the pinch rollers 62.

The guide rail 15 is attached to the housing 100 so as to extend in a main scanning direction (i.e., left-right direction) above the table 20. The carriage driving mechanism 112 reciprocally moves the carriage 12 in the main scanning direction along the guide rail 15. On the carriage 12, the plurality of printing heads 12A facing the table 20 and the medium Me in the up-down direction are mounted. The printing heads 12A are inkjet heads. Namely, the printing heads 12A each have a plurality of nozzles (not shown) in a bottom surface thereof. The printing heads 12A inject ink from the nozzles toward the medium Me, and thus an image is formed on the medium Me.

As shown in FIG. 19, the feed roller 61 is located upstream in the transportation direction of the medium Me with respect to the groove 22. A portion of the feed roller 61 is buried in the table 20, and a top portion of a circumferential surface of the feed roller 61 is exposed from the top surface of the table 20. The pinch roller 62 is elevatable and is located above the feed roller 61.

The cutter mechanism 13 cuts the medium Me. The cutter mechanism 13 includes a driver 126 and the blade 13*a*. The driver 126 is mounted on the carriage 12. The blade 13*a* is coupled with the driver 126. The driver 126 is, for example, a solenoid or a motor, and drives the blade 13*a* to be raised or lowered with respect to the table 20. The groove 22 described above is located below the blade 13*a*. When being lowered, the blade 13*a* is inserted into the groove 22.

For example, the cutting mechanism 13 cuts the medium Me after the printing. Specifically, in a state where the transportation of the medium Me by the feed motor 82 is stopped, the driver 126 lowers the blade 13*a*. A servo motor 116 moves the carriage 12 in the main scanning direction. Along with the movement of the carriage 12, the blade 13*a* moves in the main scanning direction along the groove 22, and cuts the medium Me.

Like in the above-described preferred embodiments, the pinch roller 62 is located upstream in the transportation direction of the medium Me with respect to the printing heads 12A. Therefore, the medium Me may undesirably rise from the table 20 in a region downstream with respect to the pinch roller 62. Also in the case where the ends of the medium Me in the width direction are located as being shifted from the pinch rollers 62 in the main scanning direction, the medium Me may undesirably rise from the table 20. In order to avoid such situations, the clamps 30B respectively press both of two ends of the medium Me in the width direction onto the table 20.

Figure 20:
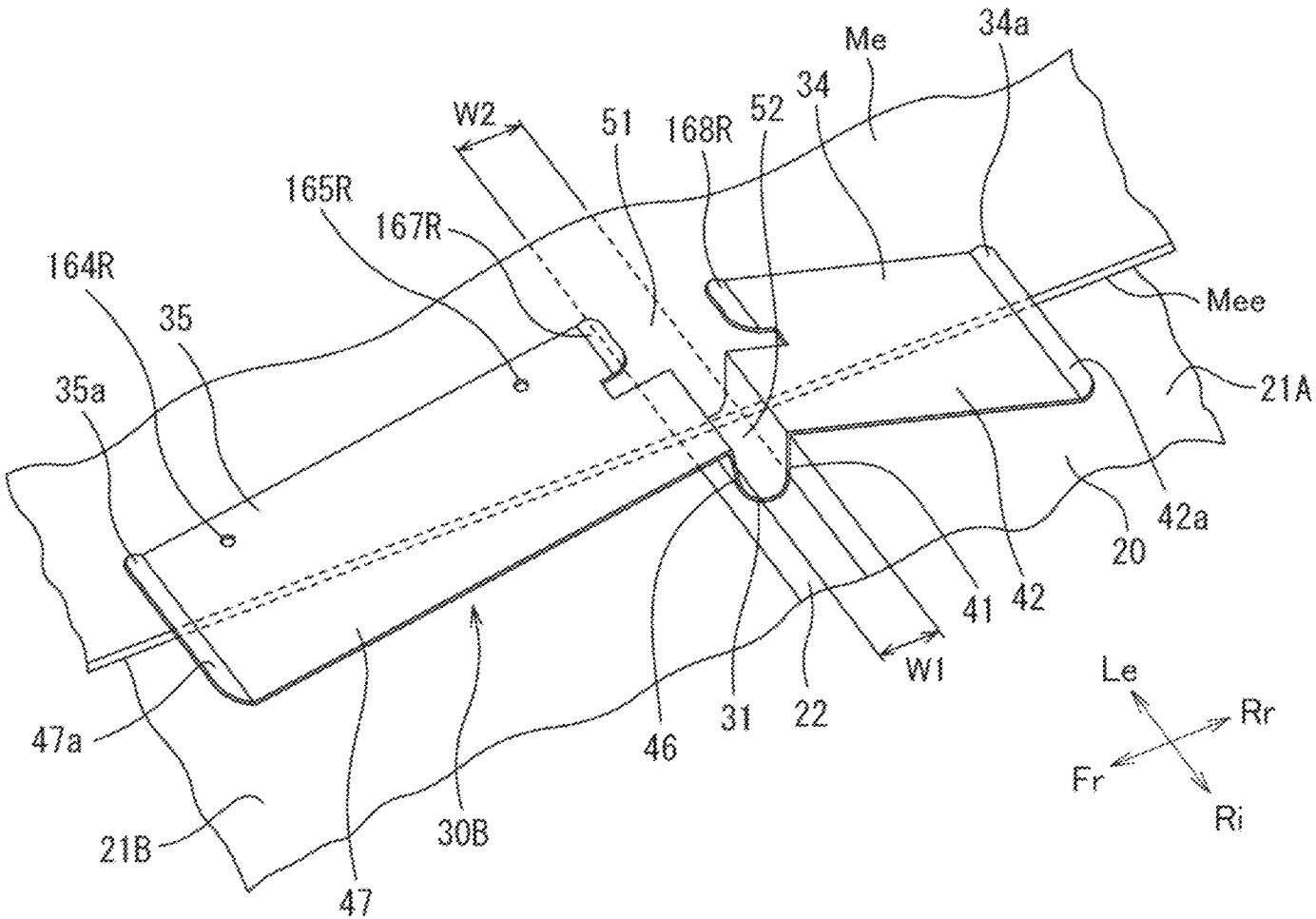
FIG. 20 is a perspective view of a clamp, a table and a medium according to preferred embodiment 3 of the present invention in a state where the table has no clamp attached thereto.
Figure 21:
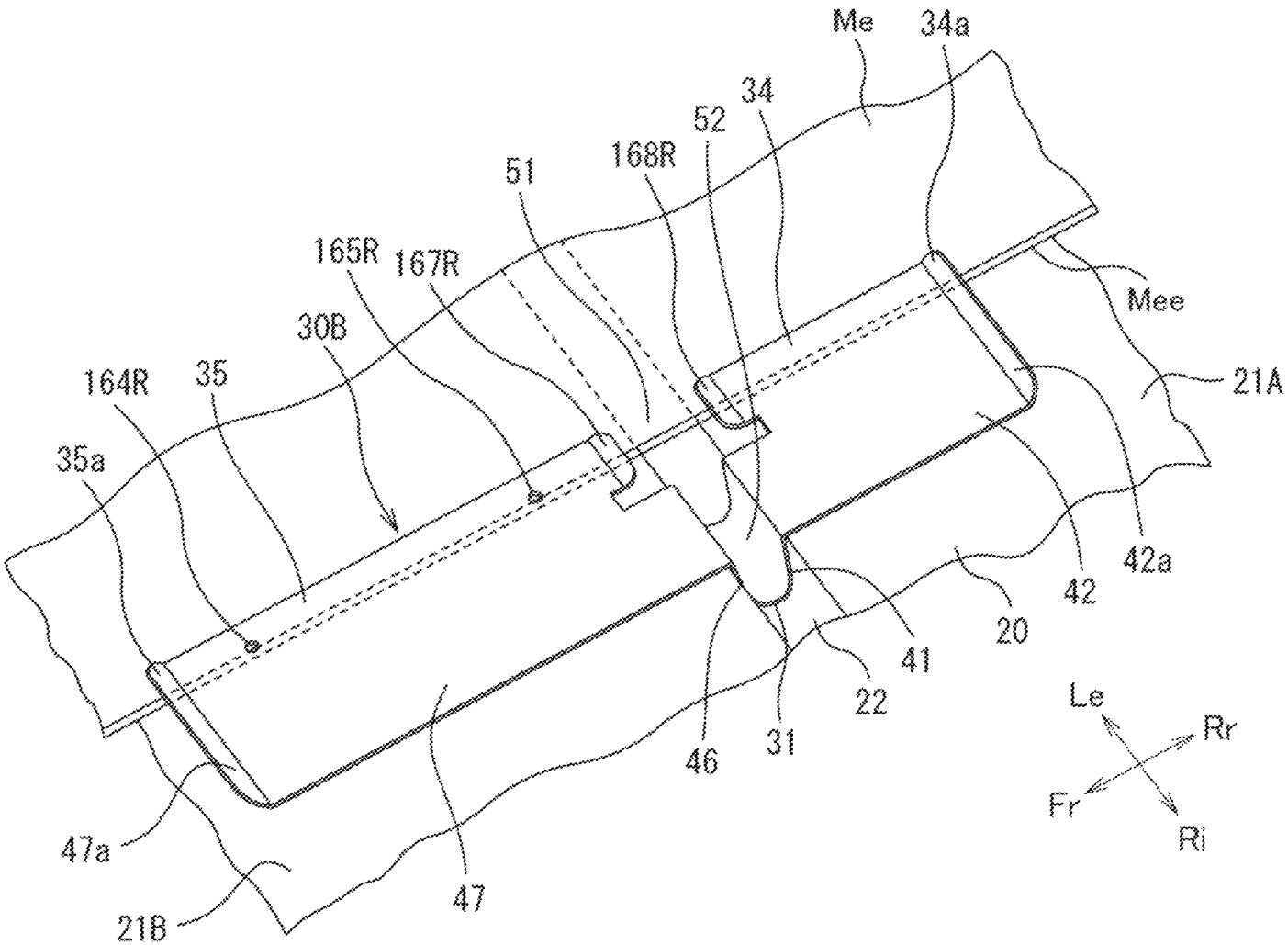
FIG. 21 is a perspective view of the clamp, the table and the medium according to preferred embodiment 3 of the present invention in a state where the clamp is attached to the table.
Figure 22:
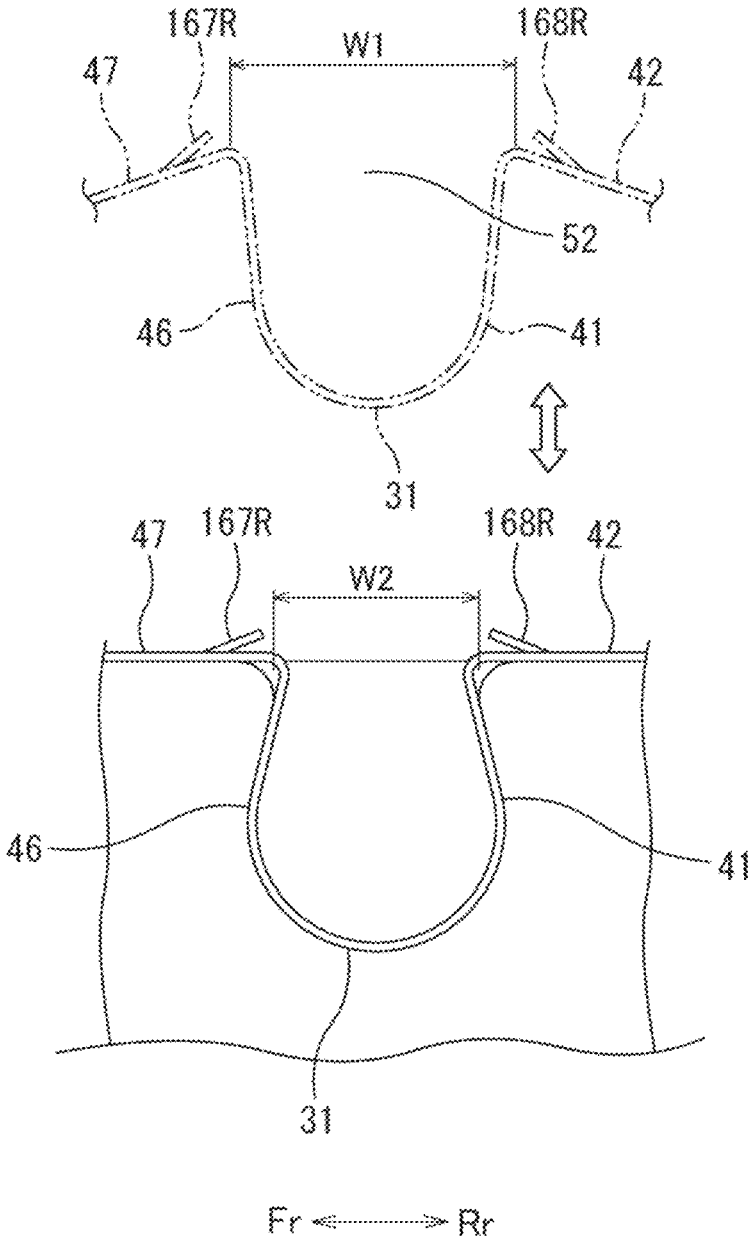
FIG. 22 is an enlarged view of portion 22 in FIG. 19.

Now, a structure of the clamps 30B according to preferred embodiment 3 will be described in detail. FIG. 20 and FIG. 21 are each a perspective view of the table 20 and the right clamp 30B. FIG. 22 is an enlarged view of portion 22 in FIG. 19. FIG. 20 shows a state where the table 20 has no clamp 30B attached thereto, and FIG. 21 shows a state where the clamp 30B is attached to the table 20. FIG. 22 shows the clamp 30B attached to the table 20 with the solid line, and shows the clamp 30B detached from the table 20 with the two-dot chain line. The left clamp 30B is bilaterally symmetric in shape to the right clamp 30B, and thus will not be described in detail.

As shown in FIG. 20 and FIG. 21, the clamp 30B according to preferred embodiment 3 is formed of a leaf spring formed by press-molding a thin steel plate (e.g., thin stainless steel plate). In this preferred embodiment, the base portion 31, the first rising portion 41, the second rising portion 46, the first extending portion 42, the second extending portion 47, the first clamp portion 34 and the second clamp portion 35 are integrally molded.

The first clamp portion 34 and the second clamp portion 35 are formed to be thin. The gap 51 is provided between the first clamp portion 34 and the second clamp portion 35. In a state of being pressed, the medium Me is exposed to the gap 51 between the clamp portions 34 and 35.

The tip portion 42*a* of the first extending portion 42 and the tip portion 34*a* of the first clamp portion 34 are inclined with respect to the first top surface 21A so as to be raised as being closer to tips thereof. A tip portion 168R, of the first clamp portion 34, closer to the second clamp portion 35, is also inclined with respect to the first top surface 21A so as to be raised as being closer to a tip thereof. The tip portion 47*a* of the second extending portion 47 and the tip portion 35*a* of the second clamp portion 35 are inclined with respect to the second top surface 21B so as to be raised as being closer to tips thereof. A tip portion 167R, of the second clamp portion 35, closer to the first clamp portion 34, is also inclined with respect to the second top surface 21B so as to be raised as being closer to a tip thereof.

Through-holes 164R and 165R are formed in the second clamp portion 35. Presence/absence of the medium Me may be checked through the through-holes 164R and 165R, so that the relative position in the left-right direction of the clamp 30B with respect to the medium Me is adjusted.

Through-holes may be formed in the first clamp portion 34, like in the second clamp portion 35. Similar through-holes may be formed in the clamps 30 and 30A in the above-described preferred embodiments.

The assembly of the base portion 31, the first rising portion 41 and the second rising portion 46 may be formed to be recessed in a V shape, a semi-arc shape or a generally C shape. In this example, as shown in FIG. 22, the assembly of the base portion 31, the first rising portion 41 and the second rising portion 46 is formed to be recessed in a bow shape (U shape or semi-elliptical shape). The groove 22 is also preferably recessed in a bow shape. Therefore, the entirety of the assembly of the base portion 31, the first rising portion 41 and the second rising portion 46 is easily fit into the groove 22.

As represented by the two-dot chain line in FIG. 22, in a state where the clamp 30B is out of the groove 22, width W1 of the gap 52 between the first rising portion 41 and the second rising portion 46 is wider than width W2 of a top end of the groove (see also FIG. 20). Therefore, as represented by the solid line in FIG. 22, in a state where the clamp 30B is fit into the groove 22, the first rising portion 41 and the second rising portion 46 are elastically compressed (see also FIG. 21). This secures the first rising portion 41 and the second rising portion 46 to the groove 22 and do not come out of the groove 22 easily.

As shown in FIG. 22, in a state where the clamp 30B is detached from the table 20, the first extending portion 42 and the second extending portion 47 are inclined upward with respect to the left-right direction as being closer to each other. By contrast, in a state where the clamp 30B is attached to the table 20, the first extending portion 42 and the second extending portion 47 extend in the left-right direction along the top surface of the table 20. The first extending portion 42 and the second extending portion 47 are each supplied with a downward urging force. With such an arrangement, the first clamp portion 34 continuous from the first extending portion 42 presses the medium Me onto the first top surface 21A, and the second clamp portion 35 continuous from the second extending portion 47 presses the medium Me onto the second top surface 21B.

As shown in FIG. 19, the length in the front-rear direction of the clamp 30B, namely, the length of the clamp 30B from a downstream-side end to an upstream-side end, is longer than the length in the front-rear direction of each printing head 12A, and is also longer than the length in the front-rear direction of the carriage 12. In a state where the clamp 30B is attached to the table 20, a downstream-side end of the second clamp portion 35 is located to the front of a front end of each printing head 12A and a front end of the carriage 12, and an upstream-side end of the first clamp portion 34 is located to the rear of a rear end of each printing head 12A and a rear end of the carriage 12. Therefore, the medium Me is prevented from rising from the table 20 in the entirety of the front-rear direction of each printing head 12A and in the entirety of the front-rear direction of the carriage 12. As the distance from the feed roller 61 and the pinch roller 62 to a rear end of the first clamp portion 34 is shorter, the effect of preventing the medium Me from rising is greater.

Now, a method for attaching the clamp 30B will be described. First, as shown in FIG. 20, the clamp 30B is positioned above a right side edge Mee of the medium Me to determine the attitude of the clamp 30B. Specifically, the base portion 31 is located above the groove 22, the first extending portion 42 and the second extending portion 47 are located to the right of the medium Me, and the first clamp portion 34 and the second clamp portion 35 are located above the medium Me.

The clamp 30B is lowered to fit the base portion 31, the first rising portion 41 and the second rising portion 46 into the groove 22. As a result, as shown in FIG. 21, the medium Me is held between the first clamp portion 34 and the first top surface 21A and between the second clamp portion 35 and the second top surface 21B. At this point, the medium Me is visually recognized through the through-holes 164R and 165R. The through-holes 164R and 165R are located as overlapping the right side edge Mee of the medium Me, so that the medium Me is pressed by the clamp portions 34 and 35. As a result, the position in the left-right direction of the clamp 30B is determined.

While the clamp 30B is being fit into the groove 22, the first rising portion 41 and the second rising portion 46 are elastically compressed such that a gap between top portions of the first rising portion 41 and the second rising portion 46 is shortened. The first extending portion 42 and the second extending portion 47 are elastically deformed so as to be along the first top surface 21A and the second top surface 21B. The elastic force generated inside the clamp 30B defines and functions as a force by which the clamp portions 34 and 35 press the medium Me onto the table 20.

Although not described, the left clamp 30B is attached to the table in substantially the same manner. The left clamp 30B presses a left side edge of the medium Me onto the table 20.

In order to detach the clamp 30B from the table 20, at least the first extending portion 42/first clamp portion 34 or the second extending portion 47/second clamp portion 35 are pulled up. Specifically, the clamp 30B is detached from the table 20 as follows.

First, the tip portion 34*a* or the tip portion 42*a* is hooked with a fingertip or the like and pulled up, so that the first clamp portion 34 and the first extending portion 42 are risen with the base portion 31 being used as the fulcrum. When the first clamp portion 34 and the first extending portion 42 are thus risen, the first rising portion 41 is elastically compressed so as to be closer to the second rising portion 46, and the base portion 31, the first rising portion 41 and the second rising portion 46 are pulled upward out of from the groove 22. This allows the clamp 30B to be separated upward from the table 20. Alternatively, the tip portion 35*a* or the tip portion 47*a* may be hooked with a fingertip or the like and pulled up, so that the clamp 30B is pulled out of the groove 22 easily.

The left clamp 30B is detached from the table 20 in substantially the same manner.

The printer device 10A according to this preferred embodiment includes the controller 70 (see FIG. 10), like the printer device 10 according to preferred embodiment 1. An operation of the printer device 10A according to this preferred embodiment is substantially the same as the operation of the printer device 10 according to preferred embodiment 1. This preferred embodiment provides substantially the same effects as those of preferred embodiment 1.

Although not described in detail, in this preferred embodiment also, the printer device 10A performs the above-described operations in a state where the clamp 30B is attached to the table 20 of the printer device 10A. Namely, the printer device 10A executes the printing and the sheet cutting as described above. Therefore, the clamp 30B prevents the medium Me from rising, and the operation of cutting the medium Me is performed easily and quickly. In addition, the post-cutting first medium Me1 is prevented from riding on the post-cutting second medium Me2. This allows the post-cutting first medium Me1 and the post-cutting second medium Me2 to be transported in a favorable manner.

Preferred Embodiment 4

Figure 23:
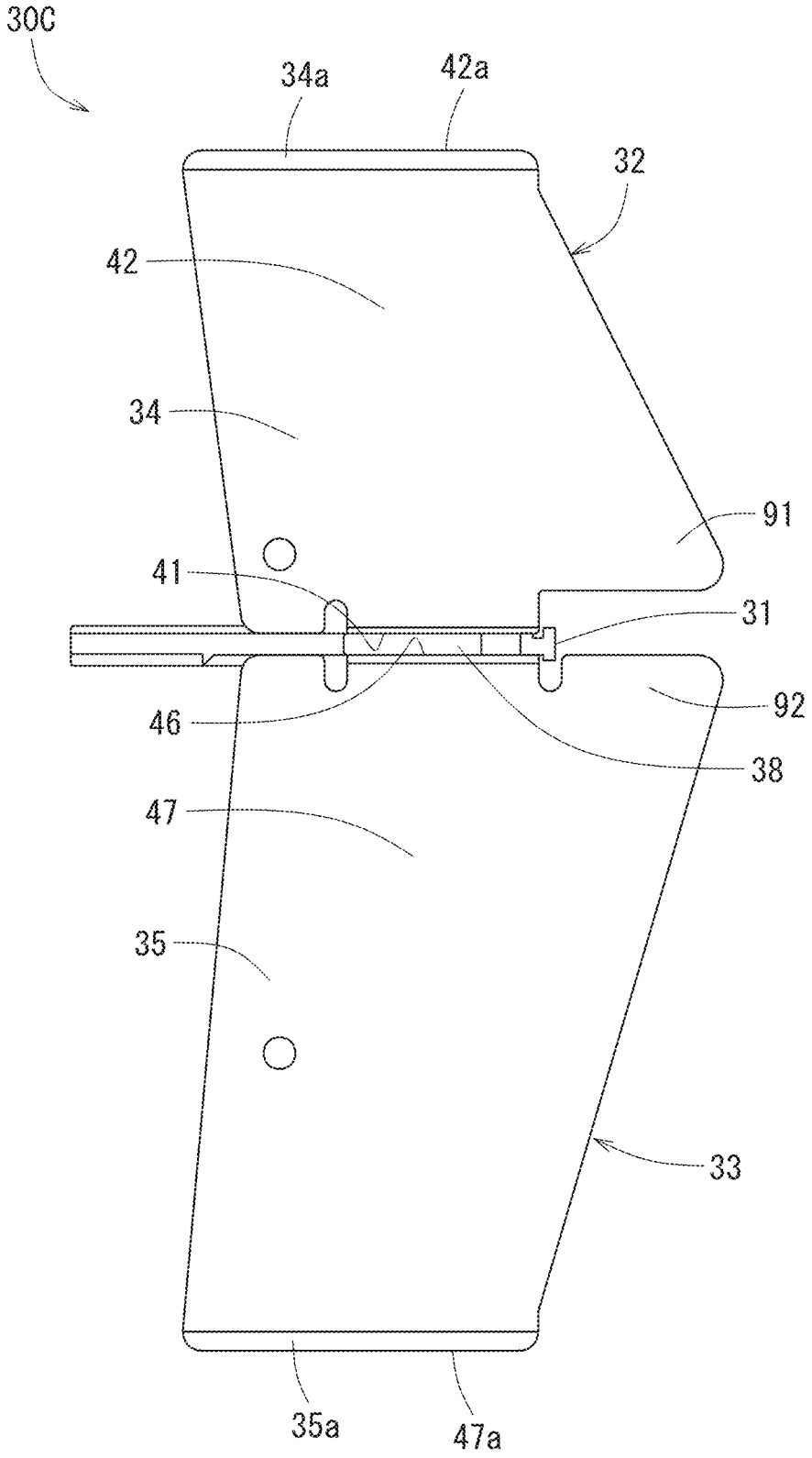
FIG. 23 is a plan view of a clamp according to preferred embodiment 4 of the present invention.

FIG. 23 is a plan view of a clamp 30C according to preferred embodiment 4 of the present invention. In the clamp 30C according to preferred embodiment 4, the first extending portion 42 is provided with a first extended portion 91 located on the side opposite to the first clamp portion 34 (right side in FIG. 24). The second extending portion 47 is provided with a second extended portion 92 located on the side opposite to the second clamp portion 35. The first extended portion 91 and the second extended portion are separate from each other in the front-rear direction. Regarding the other basic elements, the clamp 30C is substantially the same as the clamp in each of the above-described preferred embodiments. An operation of the printer device according to preferred embodiment 4 is substantially the same as the operation of the printer device 10 according to preferred embodiment 1.

As described above, the cutter mechanism 13 (see FIG. 2) may include a roller that presses the medium Me. In this case, when the cutter mechanism 13 is moved in the left-right direction, the roller presses the medium Me onto the table 20 while rolling on the medium Me. In the clamps 30, 30A and 30B according to preferred embodiments 1, 2 and 3, while the roller moves from an outer position to a central position (while the roller advances leftward in FIG. 3, FIG. 16 and FIG. 21), the roller first collides against an end surface of an area extending from the first extending portion 42 to the first rising portion 41 and an end surface of an area extending from the second rising portion 46 to the second extending portion 47. An area where the first rising portion 41 and the first extending portion 42 are connected with each other, and an area where the second rising portion 46 and the second extending portion 47 are connected with each other, are curved. Therefore, it is concerned that while the roller is riding on the curved portion, a resistance is generated, and as a result, each of the clamps 30, 30A and 30B is pushed in the direction in which the roller advances (leftward) and is positionally shifted.

In the clamp 30C according to this preferred embodiment, the first extending portion 42 and the second extending portion 47 are coupled with each other in the front-rear direction via the base portion 31, whereas the first extended portion 91 and the second extended portion 92 are not coupled with each other in the front-rear direction. The first extended portion 91 and the second extended portion 92 are spaced away from each other in the front-rear direction. The first extended portion 91 and the second extended portion 92 are elastically deformed more easily than the first extending portion 42 and the second extending portion 47. Therefore, when the roller moves leftward and rides on the first extended portion 91 or the second extended portion 92, the first extended portion 91 or the second extended portion 92 is elastically deformed. In this manner, the impact of the roller riding on the first extended portion 91 or the second extended portion 92 is alleviated. This prevents the position of the clamp 30C from being shifted.

Preferred Embodiment 5

The clamps 30, 30A, 30B and 30C in the above-described preferred embodiments each include a pair of rising portions 41 and 46 as front and rear rising portions, a pair of extending portions 42 and 47 as front and rear extending portions, and a pair of clamp portions 34 and 35 as front and rear clamp portions. Alternatively, the clamps 30, 30A, 30B and 30C may each include only the front or rear rising portion, the front or rear extending portion and the front or rear clamp portion. More specifically, each of the clamps 30, 30A, 30B and 30C may include the first rising portion 41, the first extending portion 42 and the first clamp portion 34 but may include none of the second rising portion 46, the second extending portion 47 and the second clamp portion 35. Alternatively, each of the clamps 30, 30A, 30B and 30C may include the second rising portion 46, the second extending portion 47 and the second clamp portion 35 but may include none of the first rising portion 41, the first extending portion 42 and the first clamp portion 34.

Even in such a preferred embodiment, the cutter 13*a* may be moved along the groove 22 while the medium Me is pressed onto the table 20, so that the medium Me is cut. While the medium Me is being cut, the cutter 13*a* does not interfere with the clamp 30, 30A, 30B or 30C. Therefore, the clamps 30, 30A, 30B and 30C do not need to be detached. For this reason, even in such a preferred embodiment, the medium Me is prevented from rising, and the medium Me is cut easily and quickly.

Some preferred embodiments for carrying out the present invention are described above. The above-described preferred embodiments are provided to make the present invention easy to understand, and do not limit the present invention in any way. The present invention may be altered or modified without departing from the gist thereof, and the present invention encompasses the equivalents of the alterations and modifications. Hereinafter, such alterations and modifications will be described. The above-described preferred embodiments and the alterations and modifications described below may be mutually combined in the case where such a combination is appropriate.

In the above-described preferred embodiments, the first member 32 and the second member 33 are formed of a metal material. Such a material may be changed. For example, the first member 32 and the second member 33 may be formed of a resin, a fiber-reinforced resin or a composite material (e.g., composite material of a metal material and a resin).

Figure 24:
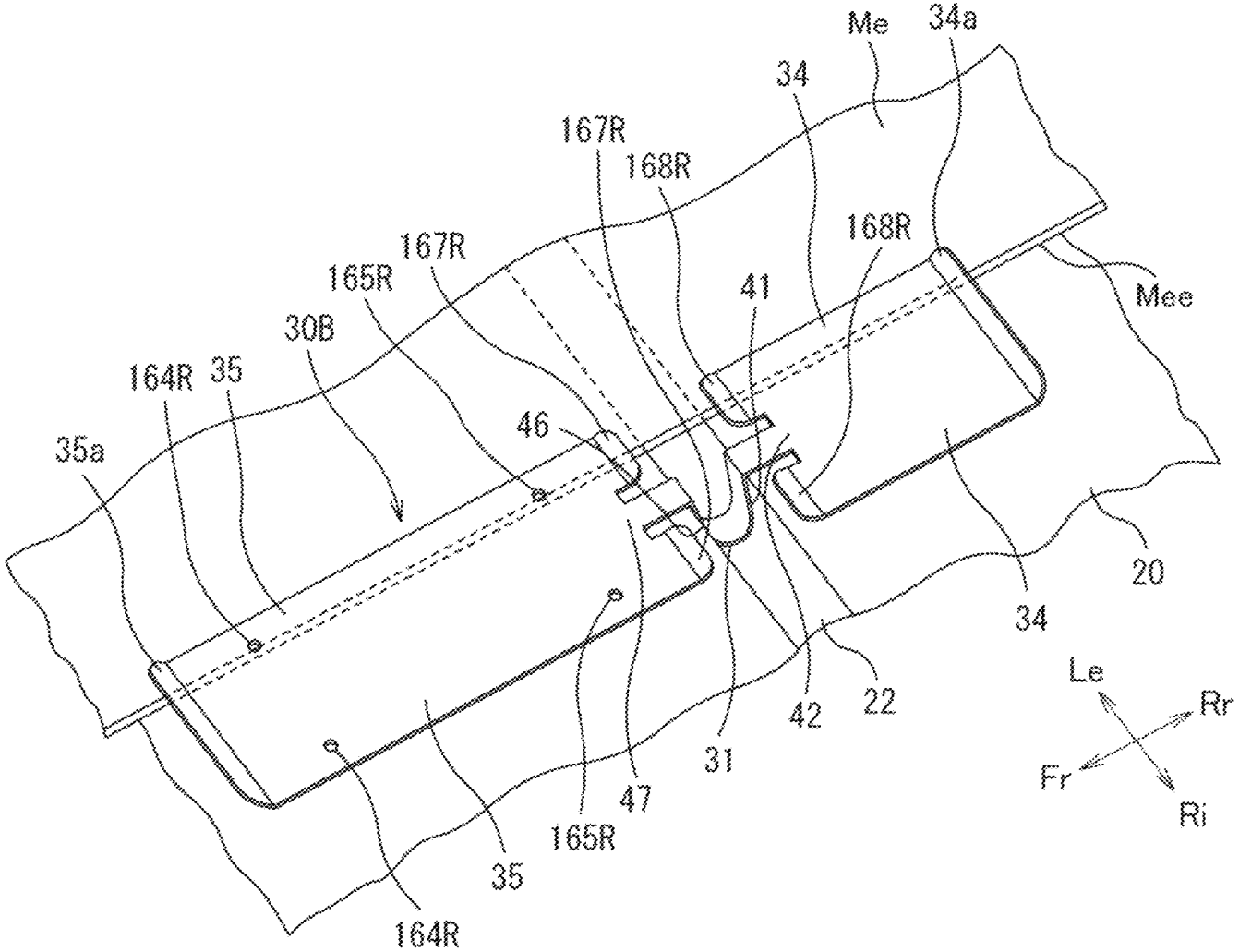
FIG. 24 is a perspective view of a clamp, a table and a medium according to a modification of a preferred embodiment of the present invention in a state where the clamp is attached to the table.

In the above-described preferred embodiments, the clamp 30B has a bilaterally asymmetric shape, and is usable exclusively for a left area or a right area of the medium Me. Alternatively, as shown in FIG. 24, the clamp 30B may have a bilaterally symmetric shape so as to be used both for the left area and the right area of the medium Me. This is also applicable to the clamps 30, 30A and 30C.

In the above-described preferred embodiments, the printer devices 10 and 10A each include the cutting mechanism 13. Alternatively, the printer devices 10 and 10A do not need to include the cutting mechanism 13. Even in this case, the clamps 30, 30A, 30B and 30C may be attached to the groove 22 of the table 20. Even if the printers 10 and 10A do not include the cutting mechanism 13, the user may insert a cutter that he/she owns into the groove 22 from above the medium Me and move the cutter in the left-right direction without the cutter interfering with the clamp 30, 30A, 30B or 30C. In this manner, the medium Me is cut.

In the above-described preferred embodiments, the groove 22 includes a bottom. Alternatively, the groove 22 may extend through the table 20 in the up-down direction.

In the above-described preferred embodiments, the groove 22 is formed in order to allow the blade 13*a* to escape thereto after the blade 13*a* pierces the medium Me. The groove 22 may be used for another use. For example, a medium detection sensor (e.g., optical sensor) that detects the medium Me may be provided in the groove 22.

In the above-described preferred embodiments, the printing heads 12A are of an inkjet printer system. Alternatively, the printing heads 12A may be of another printing system (e.g., photosensitive system such as laser printer system, LED printer system or the like, or heat transfer system).

The clamps according to preferred embodiments of the present invention are applicable to a printer device having only a function of performing printing on a medium or to a medium cutting device having only a function of cutting a medium, as well as a printer/medium cutting device. There is no specific limitation on the type of device to which the clamps according to preferred embodiments of the present invention are applicable.

The present invention is not limited to any of the above-described preferred embodiments or examples, and may be changed in any way as long as the functions and effects of the present invention are provided.

Preferred embodiments of the present invention disclosed therein encompasses the following subject matter.

Subject Matter 1

A clamp attachable to a table including a top surface and a groove in the top surface and extending in a first direction, the clamp pressing a medium placed on the top surface onto the top surface, the clamp comprising: a base portion entirely accommodatable in the groove of the table; a rising portion rising from the base portion; an extending portion extending along the top surface of the table from the rising portion in a direction away from the groove; and a clamp portion extending along the top surface from the extending portion in a direction of the first direction that is away from the rising portion, the clamp portion urging the medium toward the top surface.

Subject Matter 2

The clamp according to subject matter 1, wherein the base portion is formed separately from the rising portion, and the rising portion is secured to the base portion.

Subject Matter 3

The clamp according to subject matter 2, wherein the base portion is formed of a resin by molding, and a through-hole is formed in a portion of the rising portion that is covered with the base portion.

Subject Matter 4

The clamp according to subject matter 2, wherein the base portion includes a thin portion provided in a central portion thereof in a recessed state, the thin portion being thinner than a portion, of the base portion, into which the rising portion is inserted.

Subject Matter 5

The clamp according to subject matter 1, wherein the base portion is formed of a hard resin.

Subject Matter 6

The clamp according to subject matter 1, further comprising a spacer provided on a bottom surface of the extending portion and placed on the top surface of the table.

Subject Matter 7

The clamp according to subject matter 1, wherein a length in the first direction of the base portion is longer than a total length in the first direction of the extending portion and the clamp portion.

Subject Matter 8

The clamp according to subject matter 1, wherein the rising portion, the extending portion and the clamp portion are integrally formed of a bent plate.

Subject Matter 9

The clamp according to subject matter 1, wherein in a state before the clamp is attached to the table, an angle defined by the rising portion and the extending portion is smaller than 90 degrees.

Subject Matter 10

A medium cutting device, comprising: a table including a top surface and a groove formed in top surface and extending in a first direction; a cutter mechanism provided so as to be movable in the first direction along the groove, the cutter mechanism cutting a medium placed on the top surface; and a clamp attached to the table and pressing the medium onto the top surface, wherein the cutter mechanism is configured to cut the medium while moving in the first direction, and the clamp includes: a base portion entirely accommodatable in the groove of the table, a rising portion rising from the base portion, an extending portion extending along the top surface of the table from the rising portion, and a clamp portion extending along the top surface from the extending portion in a direction of the first direction that is away from the rising portion, the clamp portion urging the medium toward the top surface.

Subject Matter 11

The medium cutting device according to subject matter 10, wherein the groove includes a bottom wall portion, a first side wall portion rising from the bottom wall portion, and a second side wall portion rising from the bottom wall portion, the second side wall portion being and away from the first side wall portion, the first side wall portion includes a first accommodation wall portion crossing the bottom wall portion, and a first pullout-preventive wall portion located above the first accommodation wall portion and protruding toward the second side wall portion more than the first accommodation wall portion, the second side wall portion includes a second accommodation wall portion crossing the bottom wall portion, and a second pullout-preventive wall portion located above the second accommodation wall portion so as to face the first pullout-preventive wall portion and protruding toward the first side wall portion more than the second accommodation wall portion, and a size in a second direction, perpendicular to the first direction, of the base portion is smaller than a distance between the first accommodation wall portion and the second accommodation wall portion, and is larger than a distance between the first pullout-preventive wall portion and the second pullout-preventive wall portion.

Preferred embodiments of the invention disclosed herein also include the following subject matter.

Another Subject Matter 1

A medium cutting device, comprising: a table including a first top surface, a second top surface, and a groove between the first top surface and the second top surface and extending in a first direction; a feed mechanism feeding the medium at least in a downstream direction, of a second direction perpendicular to the first direction, that is from the side of the first top surface to the side of the second top surface; a cutter mechanism provided so as to be movable in the first direction along the groove, the cutter mechanism cutting a medium, placed on the first top surface and the second top surface, into an upstream-side area and a downstream-side area; an adsorption hole formed in the second top surface; an absorption device in communication with the adsorption hole so as to absorb air from above toward the adsorption hole, the absorption device causing the medium to adsorb to the second top surface; and a controller controlling the feed mechanism, the cutter mechanism and the absorption device, wherein the controller includes: a sheet cutter driving the absorption device and moving the cutter mechanism along the groove while the medium is placed on the first top surface and the second top surface, so as to execute sheet cutting, an absorption stopper stopping the absorption device after the sheet cutting, and a feeder controlling the feed mechanism to transport the medium in the downstream direction after the absorption device is stopped and to stop transporting the medium in a state where a portion of the downstream-side area of the medium is above at least a portion of the adsorption hole; and an absorption driver driving the absorption device in a state where a portion of the downstream-side area of the medium is located above at least a portion of the adsorption hole.

Another Subject Matter 2

The medium cutting device according to another subject matter 1, wherein: a plurality of the adsorption holes are arrayed in the second direction, and the feeder controls the feed mechanism to transport the medium in the downstream direction after the absorption device is stopped and to stop transporting the medium in a state where a downstream end of the upstream-side area of the medium is located downstream with respect to an upstream end of the adsorption hole located at a most upstream position among the plurality of adsorption holes.

Another Subject Matter 3

The medium cutting device according to another subject matter 1, wherein the feeder controls the feed mechanism to start transporting the medium when a predetermined time elapses after the sheet cutting is finished.

Another Subject Matter 4

The medium cutting device according to another subject matter 1, further comprising a printing head provided so as to be movable in the first direction, the printing head injecting ink, wherein: the controller includes a printer repeating an injection operation of causing the printing head to inject ink while moving the printing head in the first direction, and a feed operation of causing the feed mechanism to transport the medium in the downstream direction, so as to execute printing, and a rate at which the medium is transported in the downstream direction after the sheet cutting is lower than a maximum rate at which the printer transports the medium.

Another Subject Matter 5

The medium cutting device according to another subject matter 1, wherein: the cutting mechanism includes a cutter provided so as to be movable in the first direction, the cutter cutting the medium, the controller includes a medium cutter executing medium cutting of performing, at the same time, an operation of causing the cutter to cut the medium and a feed operation of causing the feed mechanism to transport the medium in the second direction, and a rate at which the medium is transported in the downstream direction after the sheet cutting is lower than a maximum rate at which the medium cutter transports the medium.

Another Subject Matter 6

The medium cutting device according to another subject matter 1, wherein: the cutting mechanism includes a cutter provided so as to be movable in the first direction, the cutter cutting the medium, the controller includes a medium cutter executing medium cutting of performing, at the same time, an operation of causing the cutter to cut the medium and a feed operation of causing the feed mechanism to transport the medium in the second direction, the controller includes a pre-feeder controlling the feed mechanism to execute pre-feeding of transporting the medium in the downstream direction and an upstream direction opposite to the downstream direction before the medium cutting, and a rate at which the medium is transported in the downstream direction after the sheet cutting is lower than a maximum rate at which the pre-feeder transports the medium during the pre-feeding.

Another Subject Matter 7

The medium cutting device according to another subject matter 1, further comprising a clamp attached to the table, the clamp pressing the medium onto the first top surface and the second top surface.

Another Subject Matter 8

A medium cutting device, comprising: a table including a first top surface, a second top surface, and a groove between the first top surface and the second top surface and extending in a first direction; a feed mechanism feeding the medium at least in a downstream direction, of a second direction perpendicular to the first direction, that is from the side of the first top surface to the side of the second top surface; a cutter mechanism provided so as to be movable in the first direction along the groove, the cutter mechanism cutting a medium, placed on the first top surface and the second top surface, into an upstream-side area and a downstream-side area; an adsorption hole formed in the second top surface; an absorption device in communication with the adsorption hole so as to absorb air from above toward the adsorption hole, the absorption device causing the medium to adsorb to the second top surface; and a controller controlling the feed mechanism, the cutter mechanism and the absorption device, wherein: the cutter mechanism includes a cutter provided so as to be movable in the first direction, the cutter cutting the medium, and the controller includes: a sheet cutter driving the absorption device and moving the cutter mechanism along the groove while the medium is placed on the first top surface and the second top surface, so as to execute sheet cutting, an absorption stopper stopping the absorption device after the sheet cutting, and a feeder controlling the feed mechanism to transport the medium in the downstream direction after the absorption device is stopped; and a medium cutter executing medium cutting of performing, at the same time, an operation of causing the cutter to cut the medium and a feed operation of causing the feed mechanism to transport the medium in the second direction, and a rate at which the medium is transported in the downstream direction after the sheet cutting is lower than a maximum rate at which the medium cutter transports the medium.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or discussed during the prosecution of the present application.

What is claimed is:

1. A medium cutting device, comprising:

a table including a first top surface, a second top surface, and a groove between the first top surface and the second top surface and extending in a first direction;

a cutter mechanism movable in the first direction along the groove to cut a medium placed on the first top surface and the second top surface; and a clamp attached to the table to press the medium onto the first top surface and the second top surface; wherein the clamp includes:

a base portion accommodatable in the groove of the table;

a first rising portion rising from the base portion;

a first extending portion extending along the first top surface of the table from the first rising portion;

a second rising portion rising from the base portion;

a second extending portion extending along the second top surface of the table from the second rising portion;

a first clamp portion extending in the first direction along the first top surface from the first extending portion to urge the medium toward the first top surface; and a second clamp portion extending in the first direction along the second top surface from the second extending portion to urge the medium toward the second top surface; wherein a gap located above the groove of the table is between the first clamp portion and the second clamp portion.

2. The medium cutting device according to claim 1, wherein a gap located above the groove of the table is between the first rising portion and the second rising portion.

3. The medium cutting device according to claim 1, wherein the base portion is a separate structure from the first rising portion and the second rising portion; and the first rising portion and the second rising portion are secured to the base portion.

4. The medium cutting device according to claim 3, wherein the base portion is made of a resin-molded material; and a through-hole is provided in a portion of each of the first rising portion and the second rising portion that is covered with the base portion.

5. The medium cutting device according to claim 3, wherein the base portion includes a thin portion provided in a central portion thereof in a recessed state, the thin portion being thinner than a portion, of the base portion, into which the first rising portion and the second rising portion are inserted.

6. The medium cutting device according to claim 1, wherein the base portion is made of a hard resin.

7. The medium cutting device according to claim 1, further comprising: a first spacer provided on a bottom surface of the first extending portion and placed on the first top surface of the table, and a second spacer provided on a bottom surface of the second extending portion and placed on the second top surface of the table.

8. The medium cutting device according to claim 1, wherein a length in the first direction of the base portion is longer than a total length in the first direction of the first extending portion and the first clamp portion, and is longer than a total length in the first direction of the second extending portion and the second clamp portion.

9. The medium cutting device according to claim 1, wherein the first rising portion, the first extending first clamp portion are integrally defined by the second rising portion, and the second rising portion, the second extending portion and second clamp portion are integrally defined by a bent plate.

10. The medium cutting device according to claim 1, wherein in a state before the clamp is attached to the table, an angle defined by the first rising portion and the first extending portion is smaller than 90 degrees, and an angle defined by the second rising portion and the second extending portion is smaller than 90 degrees."

11. The medium cutting device according to claim 1, wherein the groove includes a first side wall portion and a second side wall portion away from the first side wall portion; and the first rising portion and the second rising portion are spaced away from the first side wall portion and the second side wall portion.

12. The medium cutting device according to claim 1, wherein the groove includes a bottom wall portion, a first side wall portion rising from a portion of the bottom wall portion closer to the first top surface, and a second side wall portion rising from a portion of the bottom wall portion closer to the second top surface, the second side wall portion being spaced away from the first side wall portion;

the first side wall portion includes a first accommodation wall portion crossing the bottom wall portion, and a first pullout-preventive wall portion located above the first accommodation wall portion and protruding toward the second side wall portion more than the first accommodation wall portion;

the second side wall portion includes a second accommodation wall portion crossing the bottom wall portion, and a second pullout-preventive wall portion located above the second accommodation wall portion so as to face the first pullout-preventive wall portion and protruding toward the first side wall portion more than the second accommodation wall portion; and a size in a second direction, perpendicular to the first direction, of the base portion is smaller than a distance between the first accommodation wall portion and the second accommodation wall portion, and is larger than a distance between the first pullout-preventive wall portion and the second pullout-preventive wall portion.

13. The medium cutting device according to claim 1, further comprising:

an adsorption hole in the second top surface of the table;

an absorption device in communication with the adsorption hole so as to absorb air from above toward the adsorption hole, the absorption device causing the medium to adsorb to the second top surface;

a feed mechanism feeding the medium along the first top surface and the second top surface of the table; and a controller controlling the cutter mechanism, the absorption device and the feed mechanism; wherein the controller includes:

a sheet cutter to drive the absorption device and move the cutter mechanism along the groove while the medium is placed on the first top surface and the second top surface, so as to execute sheet cutting;

an absorption stopper to stop the absorption device after the sheet cutting; and a feeder to control the feed mechanism such that the medium is transported from the side of the first top surface to the side of the second top surface after the absorption device is stopped.

14. The medium cutting device according to claim 13, wherein the feed mechanism feeds the medium at least in a second direction perpendicular to the first direction, the second direction being a downstream direction from the side of the first top surface to the side of the second top surface;

the cutter mechanism cuts the medium, placed on the first top surface and the second top surface, into an upstream-side area and a downstream-side area;

the feeder of the controller controls the feed mechanism to transport the medium in the downstream direction after the absorption device is stopped and to stop transporting the medium in a state where a portion of the downstream-side area of the medium is located above at least a portion of the adsorption hole; and the controller includes an absorption to drive the absorption device in a state where a portion of the downstream-side area of the medium is located above at least a portion of the adsorption hole.

15. The medium cutting device according to claim 14, wherein a plurality of the adsorption holes are arrayed in the second direction; and the feeder controls the feed mechanism to transport the medium in the downstream direction after the absorption device is stopped and to stop transporting the medium in a state where a downstream end of the upstream-side area of the medium is located downstream with respect to an upstream end of the adsorption hole located at a most upstream position among the plurality of adsorption holes.

16. The medium cutting device according to claim 13, wherein the feeder controls the feed mechanism to start transporting the medium when a predetermined time elapses after the sheet cutting is finished.

17. The medium cutting device according to claim 13, further comprising a printing head movable in the first direction, the printing head injecting ink; wherein the controller includes a printer to repeat an injection operation of causing the printing head to inject ink while moving the printing head in the first direction, and a feed operation of causing the feed mechanism to transport the medium from the side of the first top surface to the side of the second top surface, so as to execute printing; and a rate at which the feeder transports the medium is lower than a rate at which the printer transports the medium.

18. The medium cutting device according to claim 13, wherein the cutting mechanism includes a cutter movable in the first direction to cut the medium;

the controller includes a medium cutter to execute medium cutting of performing, at the same time, an operation of causing the cutter to cut the medium and a feed operation of causing the feed mechanism to transport the medium in a second direction perpendicular to the first direction; and a rate at which the medium is transported in a downstream direction after the sheet cutting is lower than a maximum rate at which the medium cutter transports the medium.

19. The medium cutting device according to claim 13, wherein the cutting mechanism includes a cutter movable in the first direction to cut the medium;

the controller includes a medium cutter to execute medium cutting of performing, at the same time, an operation of causing the cutter to cut the medium and a feed operation of causing the feed mechanism to transport the medium in a second direction perpendicular to the first direction;

the controller includes a pre-feeder to control the feed mechanism to execute pre-feeding of transporting the medium in a downstream direction and an upstream direction opposite to the downstream direction before the medium cutting; and a rate at which the medium is transported in the downstream direction after the sheet cutting is lower than a maximum rate at which the pre-feeder transports the medium during the pre-feeding.

* * * * *